US006524783B2

(12) United States Patent
Kiyoto

(10) Patent No.: US 6,524,783 B2
(45) Date of Patent: Feb. 25, 2003

(54) SILVER HALIDE PHOTOGRAPHIC LIGHTSENSITIVE MATERIAL

(75) Inventor: Naoharu Kiyoto, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/960,326

(22) Filed: Sep. 24, 2001

(65) Prior Publication Data

US 2002/0076665 A1 Jun. 20, 2002

(30) Foreign Application Priority Data

Sep. 27, 2000 (JP) ..... 2000-294852

(51) Int. Cl.[7] ..... G03C 1/035
(52) U.S. Cl. ..... 430/567
(58) Field of Search ..... 430/567

(56) References Cited

FOREIGN PATENT DOCUMENTS

| | | |
|---|---|---|
| EP | 0 570 912 A2 * | 12/1993 |
| GB | 2313673 | 12/1997 |
| WO | 0038011 | 6/2000 |

* cited by examiner

*Primary Examiner*—Hoa Van Le
(74) *Attorney, Agent, or Firm*—Birch, Stewart, Kolasch & Birch, LLP

(57) ABSTRACT

A silver halide photographic lightsensitive material has at least one lightsensitive silver halide emulsion layer on a support. At least one layer in the lightsensitive silver halide emulsion layers comprise a lightsensitive silver halide emulsion containing silver halide grains in which a ratio of "the number of silver halide grains having at least two development initiating points per grain" to "the number of silver halide grains having at least one development initiating point per grain" is 45% or less when the silver halide photographic lightsensitive material is subjected to a specific gamma ray radiation and subsequent specific development under the conditions described in the specification.

18 Claims, No Drawings

SILVER HALIDE PHOTOGRAPHIC LIGHTSENSITIVE MATERIAL

CROSS-REFERENCE TO RELATED APPLICATIONS

This application is based upon and claims the benefit of priority from the prior Japanese Patent Application No. 2000-294852, filed Sep. 27, 2000, the entire contents of which are incorporated herein by reference.

BACKGROUND OF THE INVENTION

1. Field of the Invention

The present invention relates to, in particular, a silver halide photographic lightsensitive material whose deterioration of photographic properties due to radiation is alleviated.

2. Description of the Related Art

Recently, requirements of photographic lightsensitive materials, in particular, of image-taking photosensitive material have become stricter and stricter. In addition to high sensitivity, it is required to further reduce the graininess deterioration due to radiation exposure, and an improved emulsion to be used for the photographic material is required.

There is a technique of including tabular silver halide grains (hereinafter referred to as "tabular grains") in order to achieve a highly sensitive silver halide emulsion. A method of manufacturing and a technique of using tabular grains are disclosed in U.S. Pat. Nos. 4,434,226, 4,439,520, 4,414,310, 4,433,048, 4,414,306, and 4,459,353, and Jpn. Pat. Appln. KOKAI Publication No. (hereinafter referred to as "JP-A-") 59-99433 and JP-A-62-209445. Known advantages of tabular grains are an enhancement of sensitivity, including improvements in the color sensitizing efficiency by sensitizing dyes, improvements in the sensitivity/graininess relationship, improvements in the sharpness due to specific optical characteristics of tabular grains, and improvements in the covering power, etc. Generally, in order to improve the sensitivity of a silver halide emulsion, it is effective to use tabular grains of a large size and a high aspect ratio.

In the meantime, it has been gradually found that deterioration of photographic properties due to long-term storage of photographs is increased as sensitivity is improved more and more. In particular, it is a great problem in a color negative photographic lightsensitive material of ISO 400 or more. Deterioration of photographic properties due to long-term storage is caused by natural radiation (environmental radioactivity and cosmic rays), in addition to heat and moisture that are conventionally well known. The photosensitive materials exposed to natural radiation give raise to increment in fog density and deterioration of graininess. As measures against such deteriorations in photographic properties due to natural radiation, a method of reducing the application amount of silver (JP-A's-63-226650 and 63-226651), and a method of reducing the potassium content in a photographic lightsensitive material (JP-A-2-836), etc. are known. In addition, as a method of reducing fog from radiation, disclosed are a method of adding methylocyan dyes (JP-A-2-190851), a method of using a compound other than chloroauric acid as a gold sensitizer (JP-A's-4-67032, 4-68337 and 4-75053), and a method of forming development initiating points on the same plane (JP-A-5-216246). However, these documents only refer to techniques for improving the sensitivity and reducing the fog due to radiation, and do not clearly refer to a method of improving granularity which deteriorates due to radiation.

It was considered that the cause of deterioration of graininess due to radiation was the generation of locally high-density portions after development, because a plurality of grains are exposed by one photon of radiation. However, recently a cause other than the above has been clarified. It is reported that a plurality of development initiating points per grain are formed by irradiation of radiation. In such a case, when development is performed, only areas having the grains having a plurality of development initiating points per grain are developed early, and high-density portions locally appear. The greater the grain size of silver halide is, the more this effect is likely to occur (P. Broadhead., Imaging. Sci. J. 46. 107 (1998)). However, the above information only clarifies a phenomenon caused by radiation, and does not disclose at all a method of reducing the effects of radiation on granularity. As other measures for reducing the effects of radiation on granularity, there are a method of performing sufficient development (GB 2313673A), and a method of applying a physical pressure to a photosensitive material after application (WO00/38011). However, these methods are complicated and have problems for practical use. Further, these patents do not describe improvement of a reduction in the effects of radiation on granularity, by using the emulsion of the present invention.

Generally, it has been considered that the distribution of development initiating points in the case of performing exposure by light conforms to a Poisson distribution. Supposing that the ratio of grains having development initiating points of number x is P(x), P(x) is expressed by the following formula using the mean value n of development initiating points per grain.

$$P(x)=(e^{-n}\times n^{x})/x!$$

However, it was not clear whether P(x) actually conforms to the above formula, and what distribution P(x) has in the case of performing exposure by radiation.

BRIEF SUMMARY OF THE INVENTION

The inventors of the present invention have examined representative photographic lightsensitive materials. Thereby they have revealed that, in the case of performing exposure by light, the distribution of development initiating points conforms to a Poisson distribution, or is more concentrated than a Poisson distribution. Further, they have also revealed that, in the case of performing exposure by radiation, the distribution of development initiating points does not conform to a Poisson distribution, and the distribution is more dispersed than a Poisson distribution. Specifically, it was revealed that when enough light to expose 50–55% (number ratio) of the grains to have at least one respective development initiating point is applied, the ratio of the number of silver halide grains having two or more development initiating points per grain to the silver halide grains having at least one development initiating point of all the photographic lightsensitive materials that the present inventors measured, was less than 35%. In the meantime, when enough radiation to expose 50–55% (number ratio) of the grains to have at least one respective development initiating point is irradiated, the ratio of the number of silver halide grains having two or more development initiating points per grain to the silver halide grains having at least one development initiating point of all the photographic lightsensitive materials that the present inventors measured was, 45% or more. As described above, in the case of performing exposure by radiation, the number of development initiating points per grain is greater than that in the case of performing exposure by light, which causes the problem of deterioration of graininess.

An object of the present invention is to provide a photographic lightsensitive material whose granularity deterioration due to radiation is alleviated, and whose sensitivity/radiation fog ratio is improved.

As a result of diligent research, the inventor of the present invention has found that, an emulsion containing a smaller number of grains having a plurality of development initiating points per grain when irradiated, can be obtained by, for example, introducing a dislocation line inside the grains, adding a metal ion or metal complex inside the grains, or applying pressure inside the grains with a dissolver, into tabular grains each having a large grain size and a large aspect ratio. And the use of such an emulsion in a photosensitive material can alleviate granularity deterioration due to radiation and decrease sensitivity to radiation.

The above object has been achieved by the following items (1)–(7).

(1) A silver halide photographic lightsensitive material having at least one lightsensitive silver halide emulsion layer on a support, wherein at least one layer of the lightsensitive silver halide emulsion layers comprises a lightsensitive silver halide emulsion containing silver halide grains in which a ratio of "the number of silver halide grains having at least two development initiating points per grain" to "the number of silver halide grains having at least one development initiating point per grain" is 45% or less when the silver halide photographic lightsensitive material is subjected to radiation and subsequent development under the following conditions, Conditions of irradiation:

(radiation source) gamma rays irradiated from $^{60}$Co (radiation amount) enough to expose 50–55% (number ratio) of the silver halide grains contained in the lightsensitive silver halide emulsion layer to have at least one development initiating point Conditions of Development:

| (Processing method) | | |
|---|---|---|
| Step | Processing time | Processing temperature |
| Color development | 1 minute | 38° C. |
| Stop | 30 seconds | 20° C. |
| (Color developing agent) | | |
| p-N-methylaminophenol sulfate | | 2.5 g |
| L-ascorbic acid | | 10.0 g |
| Sodium metaborate tetrahydrate | | 3.5 g |
| KBr | | 1.0 g |
| $H_2O$ | | 1 lit |

(Stop Solution)

3% acetic acid aqueous solution (2) The silver halide photographic lightsensitive material of above item (1), wherein the ratio of "the number of silver halide grains having at least two development initiating points per grain" to "the number of silver halide grains having at least one development initiating point per grain" is 35% or less.

(3) The silver halide photographic lightsensitive material of above item (1) or (2), wherein the lightsensitive silver halide emulsion comprises silver iodobromide or silver iodochlorobromide tabular grains having (111) faces as main planes, an average equivalent sphere diameter of 0.8 μm or more, and an average aspect ratio of 2 or more.

(4) The silver halide photographic lightsensitive material of above item (3), wherein the average aspect ratio of the tabular grains is 8 or more.

(5) The silver halide photographic lightsensitive material of above item (3), wherein the average aspect ratio of the tabular grains is 13 or more.

(6) The silver halide photographic lightsensitive material of above item (3), wherein the average aspect ratio of the tabular grains is 20 or more.

(7) The silver halide photographic lightsensitive material of any one of above items (3) to (6), wherein the average equivalent sphere diameter of the tabular grains is 1.0 μm or more.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The silver halide photosensitive material of the present invention will now be described. One of the embodiments of a preferred photosensitive material is a silver halide photographic lightsensitive material containing at least one lightsensitive silver halide emulsion layer containing a silver halide emulsion wherein a ratio of the number of silver halide grains having two or more development initiating points per grain to silver halide grains having one or more development initiating point per grain is 45% or less, when performing irradiation and performing development thereafter under the following conditions. If the ratio of the number of silver halide grains having two or more development initiating points per grain to silver halide grains having one or more development initiating points per grain exceeds 45%, graininess is not improved, which is not desirable. The ratio of the number of silver halide grains having two or more development initiating points per grain to silver halide grains having one or more development initiating points per grain is, more preferably, 35% or less.

Although the term "radiation" in the present invention mainly means natural radiation, it may also mean artificial radiation. As a method of intentionally irradiating radiation, gamma rays of $^{60}$Co can be used, for example. The radiation conditions in the present invention means an amount needed to initiate development initiating points of 50–55% (number ratio) of the emulsion grains in the lightsensitive silver halide emulsion layer, so as to have at least one respective development initiating points when gamma rays of $^{60}$Co of 37 GBq are irradiated to the emulsion for a certain time at a distance of 1 m from its source.

The development initiating point in the present invention means a point recognized as a point where development starts, by viewing the layer after performing the following development processing and stop processing.

Development Conditions:

| (Processing method) | | |
|---|---|---|
| Step | Processing time | Processing temperature |
| Color development | 1 minute | 38° C. |
| Stop | 30 seconds | 20° C. |
| (Color development agent) | | |
| p-N-methylaminophenol sulfate | | 2.5 g |
| L-ascorbic acid | | 10.0 g |
| Sodium metaborate tetrahydrate | | 3.5 g |
| KBr | | 1.0 g |
| $H_2O$ | | 1 lit |

(Stop Solution)

3% acetic acid aqueous solution

The number and locations of development initiating points formed on surfaces of grains can be searched as follows.

Specifically, a silver halide color photographic lightsensitive material is irradiated by an exposure corresponding to its effective imaging region, which is an exposure amount that is enough for 50–55% (number ratio) of the grains contained in an emulsion to have at least one development initiating point, and thereafter the developed silver formed by the development is observed through a microscope to obtain the number and locations of development initiating points.

Specifically, an irradiated silver halide photosensitive material is developed, and thereafter is soaked in an acetic acid solution to stop development and washed. Thereafter, the emulsion surface is soaked in a gelatin-degradating enzyme solution, and thereby films are stripped successively from an upper emulsion layer until reaching an emulsion layer to be observed. Then, carbon is deposited on the silver halide grains of the emulsion layer to be observed remaining on a support, and its reflecting electrons are observed by a scanning electron microscope (about 5,000–30,000 magnification).

The development initiating points are observed in a granular or filamentary form with a whitish color similar to silver halide grains, on a monochrome photograph taken by using a scanning electron microscope as described above.

Further, silver halide grains in a desired emulsion layer can be viewed even in a color photosensitive material of a multi-layer structure, by selecting the proper concentration of the gelatin-degradating enzyme solution and the proper time of soaking the material in the solution.

In the present invention, in order to research the number and locations of development initiating points formed on surfaces of tabular grains, it is desirable to observe development initiating points of at least 200 grains. For more precise research, 400 or more grains should be observed.

The form of silver halide emulsion used in a photosensitive material of the present invention (hereinafter referred to as "emulsion of the present invention") will now be described.

In the emulsion of the present invention, 50% or more of the total projected area is preferably occupied by silver iodobromide or silver iodochlorobromide tabular grains each having (111) faces as main planes. The term "tabular silver halide grain" is a generic term for a silver halide grain having a twin face or two or more parallel twin faces. The term "twin face" means a (111) face in the case where ions of all lattice points on one side of the (111) face have a mirror-image relationship to respective corresponding lattice points on the other side of the (111) face. The tabular grain has a triangular, hexagonal, or circular shape of a rounded triangle or hexagon when the grain is viewed from the vertical direction with respect to its main planes. A triangular grain has triangular, a hexagonal grain has hexagonal, and a circular grain has circular main planes parallel to each other.

The distance between the twin planes of the tabular grain of the invention can be 0.012 μm or less, as disclosed in U.S. Pat. No. 5,219,720. Also, the ratio of the distance between (111) main planes/the distance between twin planes can be 15 or more, as disclosed in JP-A-5-249585. The distances can be selected depending on purposes.

In the emulsion of the present invention, it is preferred that hexagonal tabular grains whose neighboring side ratio (maximum side length/minimum side length) is in the range of 1.5 to 1 occupy 100 to 50% of the total number of all the grains of the emulsion. The above hexagonal tabular grains more preferably occupy 100 to 70%, most preferably 100 to 80%, of the total number. In the emulsion of the present invention, it is especially preferred that hexagonal tabular grains whose neighboring side ratio (maximum side length/minimum side length) is in the range of 1.2 to 1 occupy 100 to 50% of the total number of all the grains of the emulsion. The above hexagonal tabular grains more preferably occupy 100 to 70%, most preferably 100 to 80%, of the total number. The mixing of tabular grains other than these hexagonal tabular grains into the emulsion is not favorable from the viewpoint of intergranular homogeneity.

The emulsion of the present invention contains tabular grains having an average equivalent sphere diameter of 0.8 μm or more and an average aspect ratio of 2 or more. The average aspect ratio is preferably 8 or more, more preferably 13 or more, especially preferably 20 or more. The upper limit of the average aspect ration is preferably 200. Further, in any case, the average equivalent sphere diameter is especially preferably 1.0 μm or more. The upper limit of the average equivalent sphere diameter is preferably 3.0 μm.

In the case of using grains of values outside these ranges, it is difficult to obtain the advantages of the present invention, which is not preferable.

The term "equivalent sphere diameter" in the present invention means the diameter of a sphere having a volume equal to that of the grain.

Further, the term "aspect ratio" in the present invention means the ratio of an equivalent circle diameter to the thickness of a silver halide grain. The term "equivalent circle diameter" means the diameter of a circle having an area equal to the projected area of a parallel outer surface of the grain. Specifically, an aspect ratio is the value obtained by dividing a circle equivalent diameter of a projected area of an individual silver halide grain by the thickness of the grain. As an example of a method of measuring the aspect ratio, there is a method of determining a diameter (equivalent circle diameter) and thickness of a circle having an area equal to the projected area of an individual grain by taking a transmission electron microscope photograph by means of replica plating. In this case, the thickness is calculated from the length of the shadow of a replica.

The average grain thickness of tabular grains of the present invention is preferably 0.03–0.60 μm, more preferably 0.05–0.30 μm, further preferably 0.05–0.20 4 μm, especially preferably 0.05–0.15 μm. The term "average grain thickness" means an arithmetic mean of the grain thickness of all tabular grains in the emulsion. An emulsion having an average grain thickness less than 0.03 μm is difficult to prepare. If the average grain thickness of an emulsion exceeds 0.60 μm, it is hard to obtain the merits of the tabular grains, which is not preferable.

The average equivalent circle diameter of tabular grains of the present invention is preferably 0.8–6.0 μm, more preferably 1.0–5.5 μm, further preferably 1.5–5.5 μm. The term "average equivalent circle diameter" means an arithmetic mean of equivalent circle diameters of all the tabular grains in the emulsion. If the average diameter does not fall within these ranges, it is hard to obtain the advantage of the present invention, which is not preferable.

It is preferred that the emulsion of the present invention be composed of monodisperse grains. In the present invention, the variation coefficient of grain size (equivalent sphere diameter) distribution of all silver halide grains is preferably in the range of 35 to 3%, more preferably 20 to 3%, and most preferably 15 to 3%. The terminology "variation coefficient of equivalent sphere diameter distribution" used herein means the product obtained by dividing the dispersion (standard deviation) of equivalent sphere diameters of individual tabular grains by the average equivalent sphere diameter and multiplying the resultant quotient by 100. That the variation coefficient of equivalent sphere diameter distribution of all tabular grains exceeds 35% is not favorable from the viewpoint of intergranular homogeneity. On the other hand, it is difficult to prepare an emulsion wherein the variation coefficient is below 3%.

The variation coefficient of equivalent circle diameter distribution of all grains contained in the emulsion of the present invention is preferably in the range of 40 to 3%, more preferably 25 to 3%, and most preferably 15 to 3%. The terminology "variation coefficient of equivalent circle diameter distribution" used herein means the product obtained by dividing the dispersion (standard deviation) of equivalent circle diameters of individual grains by the average equivalent circle diameter and multiplying the resultant quotient by 100. That the variation coefficient of equivalent circle diameter distribution of all grains exceeds 40% is not favorable from the viewpoint of intergranular homogeneity. On the other hand, it is difficult to prepare an emulsion wherein the variation coefficient i s below 3%.

The variation coefficient of grain thickness distribution of all tabular grains contained in the emulsion of the present invention is preferably in the range of 25 to 3%, more preferably 20 to 3%, and most to preferably 15 to 3%. The terminology "variation coefficient of grain thickness distribution" used herein means the product obtained by dividing the dispersion (standard deviation) of grain thicknesses of individual tabular grains by the average grain thickness and multiplying the resultant quotient by 100. That the variation coefficient of grain thickness distribution of all tabular grains exceeds 25% is not favorable from the viewpoint of intergranular homogeneity. On the other hand, it is difficult to prepare an emulsion wherein the variation coefficient is below 3%.

The variation coefficient of distribution of distance between twin planes of all tabular grains contained in the emulsion of the present invention is preferably in the range of 25 to 3%, more preferably 20 to 3%, and most preferably 15 to 3%. The terminology "variation coefficient of distribution of distance between twin planes" used herein means the product obtained by dividing the dispersion (standard deviation) of distance between twin planes of individual tabular grains by the average distance between twin planes and multiplying the resultant quotient by 100. That the variation coefficient of distance between twin planes of all tabular grains exceeds 25% is not favorable from the viewpoint of intergranular homogeneity. On the other hand, it is difficult to prepare an emulsion wherein the variation coefficient is below 3%.

In the present invention, although the grain thickness, aspect ratio and monodispersity can be selected within the above ranges in conformity with the purpose of the use thereof, it is desirable to employ monodisperse tabular grains of small grain thickness and high aspect ratio.

In the present invention, various methods can be employed for the formation of tabular grains of high aspect ratio. For example, the grain forming methods described in U.S. Pat. Nos. 5,496,694 and 5,498,516, can be employed.

In the production of monodisperse tabular grains of high aspect ratio, it is important to form twinned crystal nuclei of small size within a short period of time. Thus, it is desirable to perform nucleation within a short period of time under low temperature, high pBr, low pH and small gelatin amount conditions. With respect to the type of gelatin, a gelatin of low molecular weight, a gelatin whose methionine content is low or a gelatin whose amino group is modified with, for example, phthalic acid, trimellitic acid or pyromellitic acid and the like are preferably employed.

After the nucleation, physical ripening is performed to thereby eliminate nuclei of regular crystals, single twinned crystals and nonparallel multiple twinned crystals while selectively causing nuclei of parallel double twinned crystals to remain. Further ripening among the remaining nuclei of parallel double twinned crystals is preferable from the viewpoint of enhancing the monodispersity.

Also, it is preferable to perform the physical ripening, for example, in the presence of PAO (polyalkylene oxide) as described in U.S. Pat. No. 5,147,771, from the viewpoint of enhancing the monodispersity.

Thereafter, supplemental gelatin is added, and soluble silver salts and soluble halides are added to thereby effect a grain growth. The above gelatin whose amino group is modified with, for example, phthalic acid, trimellitic acid or pyromellitic acid is preferably employed as the supplemental gelatin.

Further, the grain growth can preferably be performed by adding silver halide fine grains separately prepared in advance or simultaneously prepared in a separate reaction vessel to thereby feed silver and halide.

During the grain growth as well, it is important to control and optimize the temperature of reaction mixture, pH, amount of binder, pBr, feeding speeds of silver and halide ion, etc.

In the formation of silver halide emulsion grains for use in the present invention, it is preferable to employ silver iodobromide or silver chloroiodobromide. When there is a phase containing an iodide or a chloride, the phase may be uniformly distributed in each grain, or may be localized therein.

Furthermore, other silver salts, such as silver rhodanate, silver sulfide, silver selenide, silver carbonate, silver phosphate and an organic acid salt of silver, may be contained in the form of other separate grains or as parts of silver halide grains.

In the emulsion grains of the present invention, the silver bromide content is preferably 80 mol % or more, more preferably 90 mol % or more.

The silver iodide content of the emulsion of the present invention is preferably in the range of 1 to 20 mol %, more preferably 2 to 15 mol %, and most preferably 3 to 10 mol %. Silver iodide contents of less than 1 mol % are not suitable because it becomes difficult to realize the effects of enhancing dye adsorption, increasing of intrinsic photographic speed, etc. On the other hand, silver iodide contents of more than 20 mol % are not suitable because the development velocity is generally delayed.

The variation coefficient of intergranular silver iodide content distribution in the emulsion grains for use in the present invention is preferably 30% or less, more preferably 25 to 3%, and most preferably 20 to 3%. That the variation coefficient exceeds 30% is not favorable from the viewpoint of intergranular homogeneity. The terminology "variation coefficient of intergranular silver iodide content distribution" used herein means the product obtained by dividing the standard deviation of silver iodide contents of individual emulsion grains by the average silver iodide content and multiplying the resultant quotient by 100. The silver iodide contents of individual emulsion grains can be measured by analyzing the composition of each individual grain by means of an X-ray microanalyzer.

The measuring method is described in, for example, EP No. 147,868. In the determination of the distribution of silver iodide contents of individual grains contained in the emulsion of the present invention, the silver iodide contents are preferably measured with respect to at least 100 grains, more preferably at least 200 grains, and most preferably at least 300 grains.

Each of the emulsion grains of the invention mainly comprises (111) faces and (100) faces. A ratio of an area occupied by (111) faces to all the surface area of the emulsion grains is preferably at least 70%.

On the other hand, the portion where (100) faces appear in the emulsion grains of the invention is at side surfaces of the tabular grains. The ratio of an area occupied by (100) faces to the surface area of the emulsion grains, to an area occupied by (111) faces to the surface area of the emulsion grains is preferably at least 2%, more preferably 4% or more. The control of the (100) face ratio can be conducted by referring to the descriptions in JP-A's-2-298935 and 8-334850. The ratio of (100) face can be measured by a method that uses difference of adsorption dependency between (111) face and (100) face to a spectral sensitizing dye, for example, the method described in Tani, J. Imaging Sci., 29, 165(1985).

In the emulsion grains used in the invention, an area ratio of (100) faces in the side faces of the tabular grains is preferably 15% or more, and more preferably 25% or more. The area ratio of (100) faces in the side faces of the tabular grains can be obtained by the method described, for example, in JP-A-8-334850.

That is, letting Cub be the ratio of the area which (111) faces occupy on the surface of an emulsion grain to the area which (100) faces occupy on the grain surface, an area ratio ECub of (100) faces in side faces of a tabular grain is $$Cub\times(ECD+2t)/2t$$

where

ECD: average equivalent-circle diameter ($\mu$m)

t: average grain thickness ($\mu$m)

More specifically, the (100) face ratio is controlled by controlling the pAg, halogen composition, silver halide solvent concentration, and pH during the formation of silver halide grains, or by using a compound represented by formula (I) below.

$$YO(CH_2CH_2O)_m(CH(CH_3)CH_2O)_p(CH_2CH_2O)_nY \quad (I)$$

In formula (I), Y represents a hydrogen atom, —$SO_3M$, or —COBCOOM, M represents a hydrogen atom, an alkali metal atom, an ammonium group, or an alkyl-substituted ammonium group having 5 or less A carbon atoms, B represents a chainlike or cyclic group for forming an organic dibasic acid, each of m and n represents an integer of 0 to 50, and p represents an integer of 1 to 100.

I-1

$$HO(CH_2CH_2O)_m(\overset{\overset{\displaystyle CH_3}{|}}{C}HCH_2O)_{19.8}(CH_2CH_2O)_nH$$

$(m+n=9.77)$

I-2

$$NaO_2C(CH_2)OCO(CH_2CH_2O)_m(\overset{\overset{\displaystyle CH_3}{|}}{C}HCH_2O)_{17}(CH_2CH_2O)_nCO(CH_2)_2CO_2Na$$

$(m+n=5.7)$

I-3

$$KO_2CCH{=}CHCOO(CH_2CH_2O)_m(\overset{\overset{\displaystyle CH_3}{|}}{C}HCH_2O)_{34.2}(CH_2CH_2O)_nCOCH{=}CHCO_2K$$

$(m+n=8.5)$

I-4

$$NaO_3SO(\overset{\overset{\displaystyle CH_3}{|}}{C}HCH_2O)_{17}SO_3Na$$

I-5

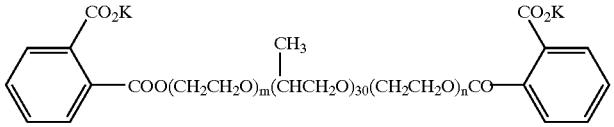

$(m+n=12)$

-continued

I-6

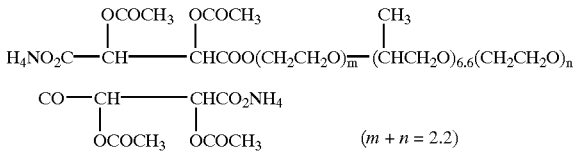

In the present invention, the addition amount of these compounds are preferably $5\times10^{-2}$ g to 10 g per mol of silver halide.

Next, there will be described a specific example of an emulsion containing silver halide grains in which the ratio of the number of silver halide grains having two or more development initiating points per grain to silver halide grains having one or more development initiating point per grain does not exceed 45% in the present invention. In the present invention, such an emulsion can be preferably prepared by (1) introducing dislocation lines inside grains, (2) adding metal ions or metal complexes inside grains, and/or (3) applying pressure to grains by a high-speed agitator using dissolver wings. However, the preparation methods are not limited to the above. The methods of above items (1)–(3) may be used individually, or two or more methods may be combined. Further, the present invention is not limited to these methods.

The tabular grains in the present invention preferably have dislocation lines inside the respective grains. A preferable grain has at least 10 dislocation lines per grain, more preferably at least 20 dislocation lines, further preferably at least 30 dislocation lines inside the grain. The introduction of dislocation lines into a tabular grain will now be described below.

A dislocation line is a linear lattice defect at the boundary between a region already slipped and a region not slipped yet on a slip plane of crystal. Dislocation lines in a silver halide crystal are described in, e.g., 1) C. R. Berry. J. Appl. Phys., 27, 636 (1956); 2) C. R. Berry, D. C. Skilman, J. Appl. Phys., 35, 2165 (1964); 3) J. F. Hamilton, Phot. Sci. Eng., 11, 57 (1967); 4) T. Shiozawa, J. Soc. Photo. Sci. Jap., 34, 16 (1971); and 5) T. Shiozawa, J. Soc. Phot. Sci. Jap., 35, 213 (1972). Dislocation lines can be analyzed by an X-ray diffraction method or a direct observation method using a low-temperature transmission electron microscope. In direct observation of dislocation lines using a transmission electron microscope, silver halide grains, extracted carefully from an emulsion so as not to apply a pressure by which dislocation lines are produced in the grains, are placed on a mesh for electron microscopic observation. While the sample is cooled in order to prevent damage (e.g., print out) due to electron rays, the observation is performed by a transmission method.

In this case, as the thickness of a grain increases, it becomes more difficult to transmit electron rays through it. Therefore, grains can be observed more clearly by using an electron microscope of high voltage type (200 kV or more for a thickness of 0.25 $\mu$m).

In the present invention, dislocation lines are preferably introduced into a tabular grain as follows. That is, dislocation lines are introduced by the epitaxial growth of a silver halide phase containing silver iodide to a tabular grain (also called a host grain) as a substrate and the formation of a silver halide shell after that.

The silver iodide content of the host grain is preferably 0 to 15 mol %, more preferably, 0 to 12 mol %, and most preferably, 0 to 10 mol %. However, this silver iodide content can be selected in accordance with the intended use. A silver iodide content exceeding 15 mol % is unpreferable because the developing speed generally lowers.

The silver iodide content in the composition of the silver halide phase epitaxially grown on the host grain is preferably as high as possible. Although this silver halide phase to be epitaxially grown can be any of silver iodide, silver iodobromide, silver iodochlorobromide, and silver iodochloride, it is preferably silver iodide or silver iodobromide, and more preferably, silver iodide. When the silver halide phase is silver iodobromide, the silver iodide (iodide ion) content is preferably 1 to 45 mol %, more preferably, 5 to 45 mol %, and most preferably, 10 to 45 mol %. This silver iodide content is preferably as high as possible to form a misfit necessary to introduce dislocation lines. However, 45 mol % is the solid solution limit of silver iodobromide.

The amount of halogen added to form this high-silver-iodide-content phase to be epitaxially grown on the host grain is preferably 2 to 15 mol %, more preferably, 2 to 10 mol %, and most preferably, 2 to 5 mol % of the silver amount of the host grain. If the halogen amount is less than 2 mol %, dislocation lines are difficult to introduce. If the halogen amount exceeds 15 mol %, the developing speed lowers.

This high-silver-iodide-content phase is preferably 5 to 30 mol %, more preferably, 5 to 20 mol % of the silver amount of the whole grain when viewed from outside the grain. An amount less than 5 mol % or exceeding 30 mol % is unpreferable because it is difficult to increase the sensitivity by the introduction of dislocation lines.

Also, this high-silver-iodide-content phase can be formed in any portion on the host grain, i.e., it can cover the host grain or can be formed only in a particular portion. It is preferable to control the positions of dislocation lines in a grain by selecting a particular portion and epitaxially growing the phase.

In the present invention, the high-silver-iodide-content phase is most preferably formed on side faces and/or corners of a host tabular grain. In this formation, it is possible to freely choose the composition and addition method of a halide to be added and the temperature, pAg, solvent concentration, gelatin concentration, and ionic strength of a reaction solution. The high-silver-iodide-content phase in a grain can be measured by an analytical electron microscope described in, e.g., JP-A-7-219102.

When this high-silver-iodide-content phase is formed on the host grain in the present invention, it is possible to preferably use, e.g., a method of adding a water-soluble iodide solution, such ad potassium iodide, singly or together with a water-soluble silver salt solution such as silver nitrate, a method of adding a silver halide containing silver iodide in the form of fine grains, or a method described in U.S. Pat. No. 5,498,516 or U.S. Pat. No. 5,527,664, the disclosers of which are incorporated herein by reference, by which iodide ions are released from an iodide ion-releasing agent by the reaction with alkali or a nucleophilic agent.

After this high-silver-iodide-content phase is epitaxially grown on the host grain, dislocation lines are introduced when a silver halide shell is formed outside the host tabular grain. Although the composition of this silver halide shell can be any of silver bromide, silver iodobromide, and silver iodochlorobromide, it is preferably silver bromide or silver iodobromide.

When the silver halide shell is silver iodobromide, the silver iodide content is preferably 0.1 to 12 mol %, more preferably, 0.1 to 10 mol %, and most preferably, 0.1 to 3 mol %.

If this silver iodide content is less than 0.1 mol %, it is difficult to obtain the advantages of enhancing dye adsorption and promoting development. If the silver iodide content exceeds 12 mol %, the developing speed generally lowers.

A silver amount used in the growth of this silver halide shell is preferably 5 to 30 mol %, and more preferably, 5 to 20 mol % of the total grain silver amount.

In the process of introducing dislocation lines described above, the temperature is preferably 30 to 80° C., more preferably, 35 to 75° C., and most preferably, 35 to 60° C. Temperature control at low temperatures less than 30° C. or at high temperatures exceeding 80° C. requires a high performance manufacturing apparatus, and this is unfavorable for the manufacture. In the above dislocation line introducing process, the pAg is preferably 6.4 to 10.5.

In the case of tabular grains, positions and the number of dislocation lines of each grain when it is viewed from the position perpendicular to its main plane can be determined by an electron microscope photograph of grains taken as described above. When dislocation lines are introduced into the tabular grains of the present invention, in order to lower the sensitivity to radiation, it is preferable to introduce dislocation lines as inward as possible. In the silver halide grains of the present invention, it is preferable that each of the grains occupying at least 50 mol %, preferably at least 80 mol %, more preferably 100 mol % of silver halide of all the grains has dislocation lines which are localized in a region from 10% to 80% of the grain volume (i.e. as the volume of the grain from the center to the periphery thereof) of the silver halide grain. It is more preferable that dislocation lines are localized inside a grain in an area corresponding to 30% to 70% of the grain volume. The sensitivity to radiation is not lowered if dislocation lines are introduced at a position exceeding 80% from the center of the grain volume. Further, it is not preferable to introduce dislocation lines at a position less than 10% from the center of the grain volume, since thin tabular silver halide grains do not grow.

However, it is preferable to introduce dislocation lines also in a fringe portion for the purpose of improving the sensitivity and pressure properties. As a method of introducing dislocation lines in a fringe portion, the methods disclosed in JP-A's-63-220238, 1-201649 and 6-258745, for example, can be preferably used.

The tabular grains in the present invention preferably contain at least one kind of photographically useful metal ion or complex (hereinafter referred to as "metal (complex) ions") inside the grains.

Metal ion doping into silver halide grains will now be described.

The useful metal (complex) ions in the present invention are doped into grains for the purpose of improving the sensitivity to radiation, and improving the graininess of a lightsensitive silver halide emulsion. These compounds work as transient or permanent traps for electrons or positive holes in silver halide crystals to lower the sensitivity to radiation and to concentrate development initiating points, thereby to produce advantages such as in alleviation of graininess deterioration caused by radiation.

As the metal for use in doping within emulsion grains in the present invention, there can preferably be employed the first to third transition metal elements such as iron, ruthenium, rhodium, palladium, cadmium, rhenium, osmium, iridium, platinum, chromium and vanadium and further amphoteric metal elements such as gallium, indium, thallium and lead. These metal ions are doped in the form of a complex salt or a single salt. With respect to the complex ion, a six-coordinate halogeno or cyano complex containing halide ion or cyanide (CN) ion as a ligand is preferably used.

Also, use can be made of a complex having a nitrosyl (NO) ligand, a thionitrosyl (NS) ligand, a carbonyl (CO) ligand, a thiocarbonyl (NCO) ligand, a thiocyanato (NCS) ligand, a selenocyanato (NCSe) ligand, a tellurocyanato (CNTe) ligand, a dinitrogen ($N_2$) ligand, an azido ($N_3$) ligand or an organic ligand such as a bipyridyl ligand, a cyclopentadienyl ligand, a 1,2-dithiolenyl ligand or an imidazolyl ligand. The following polydentate ligands may be used as the ligand. That is, use may be made of any of bidentate ligands such as a bipyridyl ligand, tridentate ligands such as diethylenetriamine, tetradentate ligands such as triethylenetetramine and hexadentate ligands such as ethylenediaminetetraacetic acid. The coordination number is preferably 6, but may be 4. With respect to the organic ligand, those described in U.S. Pat. Nos. 5,457,021, 5,360,712 and 5,462,849, the disclosures of which are incorporated herein by reference, can preferably be employed. Further, it is also preferred to incorporate the metal ion in the form of an oligomer as described in U.S. Pat. No. 5,024,939.

When the metal (complex) ion is incorporated in a silver halide, it is important whether the size of metal (complex) ion is suitable to the lattice spacing of silver halide. Further, that a compound with the silver or halide ion of the metal (complex) ion is co-precipitated together with the silver halide is essential for the doping of the silver halide with the metal (complex) ion. Accordingly, it is required that the pKsp (common logarithm of inverse number of solubility product) of the compound with the silver or halide ion of the metal (complex) ion be approximately equal to the pKsp (silver chloride 9.8, silver bromide 12.3, and silver iodide 16.1) of silver halide. Therefore, the pKsp of the compound with the silver or halide ion of the metal (complex) ion is preferably in the range of 8 to 20.

The amount of metal complex with which silver halide grains are doped is generally in the range of $10^{-9}$ to $10^{-2}$ mol per mol of silver halide. Specifically, the amount of metal complex which provides a transient shallow electron trap in the photo-stage is preferably in the range of $10^{-7}$ to $10^{-2}$ mol. On the other hand, the metal complex which provides a deep electron trap in the photo-stage is preferably used in an amount of $10^{-9}$ to $10^{-5}$ mol, per mol of silver halide. For example, the doping amount of $RhCL_6^{3-}$, which is used for deep trapping, is preferable $10^{-9}$ to $10^{-5}$ mol per mol of silver, more preferably $10^{-8}$ to $10^{-6}$ mol. The doping amount of $IrCl_6^{4-}$, which is used for shallower trapping than $RhCl_6^{3-}$, is preferable $10^{-9}$ to $10^{-4}$ mol per mol of silver, and more preferably $10^{-8}$ to $10^{-5}$ mol.

The content of metal (complex) ion in emulsion grains can be determined by the atomic absorption, polarized Zeeman spectroscopy and ICP analysis. The ligand of metal complex ion can be identified by the infrared absorption (especially, FT-IR).

When doping the above metal (complex) ions into the tabular grains of the present invention, it is preferable to dope the ions into the grains as centrally internal as possible in order to lower the sensitivity to radiation. In the silver halide grains of the present invention, it is preferable that each of grains occupying at least 50 mol %, preferably at least 80 mol %, more preferably 100 mol % of silver halide of all the grains has metal (complex) ions which are localized in 10% to 80% of the grain volume (i.e. anywhere from the center to the periphery of the grain) of the silver halide grain. It is more preferable that metal (complex) ions are localized inside a grain in an area corresponding to 30% to 70% of the grain volume. The sensitivity to radiation is not lowered if metal (complex) ions are introduced at a position exceeding 80% from the center of the grain volume. Further, it is not preferable to introduce metal (complex) ions at a position not exceeding 10% from the center of the grain volume, since thin tabular silver halide grains do not grow.

Further, when doping the above metal (complex) ions into the tabular grains of the present invention, a plurality of metal ions may be doped. The ions may be doped in the same phase, or doped in different phases. As a method of adding these compounds, the metallic salt solution may be added by mixing it into a halide aqueous solution or a water-soluble silver salt solution when forming the grains, or the metallic salt solution may be directly added. Further, silver halide emulsion fine grains doped with the metal ions may be added. When dissolving metallic salt in an appropriate solvent such as water, methanol or acetone, it is preferable to add a hydrogen halide aqueous solution (for example, HCl, HBr), thiocyanic acid or a salt thereof, or alkali halide (for example, KCl, NaCl, KBr, NaBr). Furthermore, it is preferable at the same point to add an acid or alkali and the like according to necessity.

In the case of doping metal ions of a cyano complex into emulsion grains, sometimes cyanogen is generated by the reaction between gelatin and the cyano complex and gold sensitization is inhibited. In such cases, it is preferable to also use a compound which inhibits the reaction between the gelatin and cyano complex, as described in JP-A-6-308653, for example. Specifically, it is preferable to perform the step of doping metal ions of cyano complex and the subsequent steps, under the presence of metal ions such as zinc ions, to coordinate with the gelatin.

Pressure is preferably applied to grains of the silver halide of the present invention by a high-speed agitator using dissolver wings, for example. When pressure is applied to grains, defects are generated inside the grains, and the defects serve as internal traps to reduce the sensitivity of the grains to radiation. With respect to a high-speed agitator using dissolver wings, a device described in JP-A-58-105141 is preferably used.

When pressure is applied to the silver halide of the present invention by a high-speed agitator using dissolver wings, it is preferable to increase the rpm as high as possible unless the silver halide is fogged by pressure. For example, it is preferable to agitate the silver halide at 5000–10000 rpm for 30–180 minutes. A sufficient pressure cannot be obtained with 5000 rpm or less, which does not lower the sensitivity to radiation and is not preferable. Further, an rpm exceeding 10000 rpm is not preferable, since too much pressure is applied to the silver halide, causing fog of the silver halide.

The period during which a pressure is applied to the silver halide of the present invention by a dissolver must precede the application of an emulsion. Further, the period for applying pressure preferably follows grain formation, more preferably follows spectral sensitization and/or chemical sensitization.

Emulsions of the present invention and other photographic emulsions that can be used together with the emulsions of the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by the reaction of a soluble silver salt and a soluble halogen salt, any of the single-jet method, the double-jet method, and the combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which the crystal shape is regular and the grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994, the discloses of which are herein incorporated by reference. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, European Patents (hereinafter also referred to as EU) 273,429 and 273,430, and West German Patent 3,819,241, the disclosers of which are incorporated herein by reference. This method is an effective grain formation method. To convert into a silver salt that is more sparingly soluble, it is possible to add a solution of a soluble halogen or silver halide grains. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent (hereinafter also referred to as GB) 1,469,480 and U.S. Pat. Nos. 3,650,757 and 4,242,445, the disclosures of which are incorporated herein by reference. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added, a plurality of soluble halogen salts of different solution compositions are to be added or a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364, the disclosures of which are incorporated herein by reference.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of a silver salt and a halide salt or can be introduced to the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., four-substituted thioureas described in JP-A-53-82408, JP-A-55-77737, and U.S. Pat. No. 4,221,863, and compounds described in JP-A-53-144319), mercapto compounds capable of accelerating growth of silver halide grains, described in JP-A-57-202531, and an amine compound (e.g., JP-A-54-100717).

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-degradating product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In the formation of silver halide grains of the present invention, at least one of chalcogen sensitization including sulfur sensitization and selenium sensitization, and noble metal sensitization including gold sensitization and palladium sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization speck can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred.

In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

It is preferable to perform reduction sensitization during grain formation, after grain formation but before chemical sensitization, or during chemical sensitization of the silver halide emulsion.

Reduction sensitization performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted.

Known examples of the reduction sensitizer are stannous chloride, ascorbic acid and its derivatives, amines and polyamines, hydrazine derivatives, formamidinesulfinic acid, a silane compound, and a borane compound. In reduction sensitization of the present invention, it is possible to selectively use these reduction sensitizers or to use two or more types of compounds together. Preferable compounds as the reduction sensitizer are stannous chloride, thiourea dioxide, dimethylamineborane, and ascorbic acid and its derivatives. Although the addition amount of reduction sensitizers must be so selected as to meet the emulsion manufacturing conditions, a proper amount is $10^{-7}$ to $10^{-2}$ mol per mol of a silver halide.

The reduction sensitizer is, for example, added during grain formation by dissolving thereof to water, or organic solvents such as alcohols, glycols, ketones, esters, and amides. The reduction sensitizer can previously added to a reaction vessel, but it is preferable to add the reduction sensitize at a proper timing during grain growth. It is also possible to previously add the reduction sensitizer to a solution of a water-soluble silver salt or of an alkaline halide, thereby to precipitate silver halide grains using the solutions. It is also preferable to add a solution of the reduction sensitizer at several times separately during the grain growth or add the solution for a consecutive long period.

It is preferable to use an oxidizer for silver during the process of manufacturing emulsions of the present invention. An oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate.

An oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones. The combined use of the aforementioned reduction sensitizer and the oxidizer to silver is a preferable embodiment. The method of adding the oxidizer can be selected from the method of using the oxidizer followed by performing reduction sensitization, the vice versa thereof, or the method of making both of the oxidizer and the reduction sensitizer present at the same time. These methods can be performed at a grain formation step or a chemical sensitization step.

Photographic emulsions used in the present invention can contain various compounds in order to prevent fog during the manufacturing process, storage, or photographic processing of a sensitized material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and Jpn. Pat. Appln. KOKOKU Publication No. (hereinafter referred to as JP-B-) 52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

The photographic emulsion of the present invention is preferably subjected to a spectral sensitization with at least one methine dye or the like, from the viewpoint that the effects desired in the present invention can be exerted. Examples of usable dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have at least one substituent on carbon atoms thereof.

Any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, and GB 1,344,281 and 1,507,803, JP-B's-43-4936 and 53-12375 and JP-A's-52-110618 and 52-109925.

The emulsion of the present invention may be doped with a dye which itself exerts no spectral sensitizing effect or a substance which absorbs substantially none of visible radiation and exhibits supersensitization, together with the above spectral sensitizing dye.

The emulsion may be doped with the spectral sensitizing dye at any stage of the process for preparing the emulsion which is known as being useful. Although the doping is most usually conducted at a stage between the completion of the chemical sensitization and before the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization as described in JP-A-58-113928, and also, the spectral sensitizing dye can be added prior to the completion of silver halide grain precipitation to thereby initiate the spectral sensitization. Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains, such as the method disclosed in U.S. Pat. No. 4,183,756 and other methods.

The addition amount of the spectral sensitizing dye can range from $4\times10^{-6}$ to $8\times10^{-3}$ mol per mol of the silver halide. In the case where a preferable silver halide grain size of 0.2 to 1.2 $\mu$m, the addition amount of about $5\times10^{-5}$ to $2\times10^{-3}$ is effective.

In the lightsensitive material of the present invention, it is only required that at least one silver halide emulsion layer be formed on a support. A typical example is a silver halide photographic lightsensitive material having, on its support, at least one lightsensitive layer constituted by a plurality of silver halide emulsion layers which are sensitive to essentially the same color but have different sensitivities. This lightsensitive layer includes a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color.

Various non lightsensitive layers such as an intermediate layer can be formed between the silver halide lightsensitive layers and as the uppermost layer and the lowermost layer. These intermediate layers may contain, e.g., couplers to be described later, DIR compounds and color-mixing inhibitors. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045, the disclosures of which are incorporated herein by reference. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference. In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

Furthermore, in the present invention, the photographic material may also have an emulsion layer having the fourth or more color sensitivity.

The layer of the fourth or more color sensitivity may be a layer that is sensitive to the wavelength region partly different from the region of a blue-sensitive, green-sensitive or red-sensitive layer. The layer of the fourth or more color sensitivity may be sensitive to infrared light or ultraviolet light. Couplers to be used in the layers may be selected depending on the purpose thereof.

The layer structures of the photographic material of the present invention are listed below when the photographic material of the present invention is configured to a three-layer structure. However, the present invention is not limited to these. The order herein is from the layer closest to the support.

1) low-speed red-sensitive emulsion layer (Rlu), medium-speed red-sensitive emulsion layer (RLm), high-speed red-sensitive emulsion layer (Rlo), low-speed green-sensitive emulsion layer (Glu), medium-speed green-sensitive emulsion layer (GLm), high-speed green-sensitive emulsion layer (Glo), low-speed blue-sensitive emulsion layer (Blu), medium-speed blue-sensitive emulsion layer (BLm), and high-speed blue-sensitive emulsion layer (Blo).
2) GLu, GLm, GLo, RLu, RLm, RLo, BLu, BLm, and Blo;
3) GLu, RLu, GLm, RLm, GLo, RLo, BLu, BLm, Blo;
4) GLu, GLm, RLu, RLm, GLo, RLo, BLu, BLm, Blo;
5) RLu, RLm, GLu, GLm, GLo, RLo, BLu, BLm, Blo;
6) GLu, RLu, RLm, GLm, GLo, RLo, BLu, BLm, Blo;
7) RLu, GLu, RLm, GLm, GLo, RLo, BLu, BLm, Blo;
8) GLu, GLm, RLm, Glu, RLo, GLo, BLu, BLm, Blo;
9) RLu, RLm, GLu, GLm, RLo, GLo, BLu, BLm, Blo;
10) GLu, GLm, RLu, RLm, RLo, GLo, BLu, BLm, Blo;
11) RLu, GLu, GLm, RLm, RLo, GLo, BLu, BLm, Blo; and
12) GLu, RLu, GLm, RLm, RLo, GLo, BLu, BLm, Blo Silver halide photographic lightsensitive material to which the present invention can be applied may contain various additives in accordance with its purposes.

These additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| | Types of additives | RD17643 | RD18716 | RD308119 |
|---|---|---|---|---|
| 1 | Chemical-sensitizers | page 23 | page 648 right column | page 96 |
| 2 | Sensitivity-increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, and stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column to page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column. |

With respect to the layer arrangement and related techniques, silver halide emulsions, dye forming couplers, DIR couplers and other functional couplers, various additives and development processing which can be used in the photographic lightsensitive material of the present invention and the emulsions suitable for use in the lightsensitive material, reference can be made to EP 0565096A1 (published on Oct. 13, 1993), the disclosure of which is incorporated herein by reference, and patents cited therein. Individual particulars and the locations where they are described will be listed below.

1. Layer arrangement: page 61 lines 23 to 35, page 61 line 41 to page 62 line 14,
2. Interlayers: page 61 lines 36 to 40,
3. Interlayer effect imparting layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42, 9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical sensitization of emulsion: page 63 lines 6 to 9,
13. Use of Emulsion in mixture: page 63 lines 10 to 13,
14. Fogging emulsions: page 63 lines 14 to 31,
15. Nonlightsensitive emulsions: page 63 lines 32 to 43,
16. Silver coating amounts: page 63 lines 49 to 50,
17. Photographic additives usable in the present invention are also described in RDs. Item 17643 (December, 1978), Item 18716 (November, 1979) and Item 307105 (November, 1979), the disclosures of which are incorporated herein by reference, and the relevant description portions are summarized in the following table.

| | Types of Additives | RD17643 | RD18716 | RD307105 |
|---|---|---|---|---|
| (1) | Chemical sensitizers | page 23 | page 648 right column | page 866 |
| (2) | Sensitivity increasing agents | | page 648 right column | |
| (3) | Spectral sensitizers, super sensitizers | pages 23–24 | page 648, right column to page 649, right column | pages 866–868 |
| (4) | Brighteners | page 24 | page 647, right column | page 868 |
| (5) | Anti-foggant, Stabilizer | Pages 24–25 | page 649 | page 868–870 |
| (6) | Light absorbents, filter dyes, ultraviolet absorbents | pages 25–26 | page 649, right column to page 650, left column | page 873 |
| (7) | Stain preventor | page 25 right column | page 650 left to right columns | page 872 |
| (8) | Dye image stabilizer | page 25 | page 650 left column | page 872 |
| (9) | Film hardener | page 26 | page 651 left column | page 874–875 |
| (10) | Binders | page 26 | page 651, left column | pages 873–874 |
| (11) | Plasticizers, lubricants | page 27 | page 650, right column | page 876 |
| (12) | coating aids, surfactants | pages 26–27 | page 650, right column | pages 875–876 |
| (13) | Antistatic agents | page 27 | page 650, right column | pages 876–877 |
| (14) | Matting agents | page 27 | page 650 right column | pages 878–879. |

18. Formaldehyde scavengers: page 64 lines 54 to 57,
19. Mercapto antifoggants: page 65 lines 1 to 2,
20. Fogging agent, etc.-releasing agents: page 65 lines 3 to 7,
21. Dyes: page 65, lines 7 to 10,
22. Color coupler summary: page 65 lines 11 to 13,
23. Yellow, magenta and cyan couplers: page 65 lines 14 to 25,
24. Polymer couplers: page 65 lines 26 to 28,
25. Diffusive dye-forming couplers: page 65 lines 29 to 31,
26. Colored couplers: page 65 lines 32 to 38,
27. Functional coupler summary: page 65 lines 39 to 44,
28. Bleaching accelerator-releasing couplers: page 65 lines 45 to 48,
29. Development accelerator release couplers: page 65 lines 49 to 53,
30. Other DIR couplers: page 65 line 54 to page 66 to line 4,
31. Method of dispersing couplers: page 66 lines 5 to 28,
32. Antiseptic and mildew proofing agents: page 66 lines 29 to 33,
33. Types of sensitive materials: page 66 lines 34 to 36,
34. Thickness of lightsensitive layer and swelling speed: page 66 line 40 to page 67 line 1,
35. Back layers: page 67 lines 3 to 8,
36. Development processing summary: page 67 lines 9 to 11,
37. Developers and developing agents: page 67 lines 12 to 30,
38. Developer additives: page 67 lines 31 to 44,
39. Reversal processing: page 67 lines 45 to 56,
40. Processing solution open ratio: page 67 line 57 to page 68 line 12,
41. Development time: page 68 lines 13 to 15,
42. Bleach-fix, bleaching and fixing: page 68 line 16 to page 69 line 31,
43. Automatic processor: page 69 lines 32 to 40,
44. Washing, rinse and stabilization: page 69 line 41 to page 70 line 18,
45. Processing solution replenishment and recycling: page 70 lines 19 to 23,
46. Developing agent built-in sensitive material: page 70 lines 24 to 33,
47. Development processing temperature: page 70 lines 34 to 38, and
48. Application to film with lens: page 70 lines 39 to 41.

EXAMPLES

Examples of the present invention will be set forth below, however the present invention is not limited to the examples.

Gelatin-1 to gelatin-4 used as dispersion media in emulsion preparations described below have the following attributes.

Gelatin-1: Conventional alkali-processed ossein gelatin made from bovine bones. No —$NH_2$ group in the gelatin was chemically modified.

Gelatin-2: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-3: Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified —$NH_2$ groups in the gelatin was 95%.

Gelatin-4: Gelatin formed by decreasing the molecular weight of gelatin-1 by allowing enzyme to act on it such that the average molecular weight was 15,000, deactivating the enzyme, and drying the resultant material. No —$NH_2$ group in the gelatin was chemically modified.

All of gelatin-1 to gelatin-4 described above were deionized and so adjusted that the pH of an aqueous 5% solution at 35° C. was 6.0.

(Preparation of Emulsions)

Emulsion 1-A 1,300 mL of an aqueous solution containing 0.5 g of KBr and 1.1 g of gelatin-4 described above was stirred at 35° C. (1st solution preparation). 35 mL of an aqueous solution Ag-1 (containing 4.9 g of $AgNO_3$ in 100 mL), 27 mL of an aqueous solution X-1 (containing 5.2 g of KBr in 100 mL), and 8.5 mL of an aqueous solution G-1 (containing 8.0 g of gelatin-4 described above in 100 mL) were added over 30 sec at fixed flow rates by a triple jet method (addition 1). After that, 6.5 g of KBr were added, and the temperature was raised to 75° C.

After a ripening step was performed for 20 min, 300 mL of an aqueous solution G-2 (containing 12.7 g of gelatin-3 described above in 100 mL) and 2.10 mL of a 10% methanol solution of $HO(CH_2CH_2O)_m(CH(CH_3)CH_2O)_{19.8}(CH_2CH_2O)_nH$ (m+n=9.77) were added. Next, 157 mL of an aqueous solution Ag-2 (containing 22.1 g of $AgNO_3$ in 100 mL) and an aqueous solution X-2 (containing 15.5 g of KBr in 100 mL) were added over 14 min by a double jet method. The flow rate of the aqueous solution Ag-2 during the addition was accelerated such that the final flow rate was 2.5 times the initial flow rate. Also, the aqueous solution X-2 was so added that the pAg of the bulk emulsion solution in the reaction vessel was held at 8.0 (addition 2).

Subsequently, 329 mL of an aqueous solution Ag-3 (containing 32.0 g of $AgNO_3$ in 100 mL) and an aqueous solution X-3 (containing 21.5 g of KBr and 0.9 g of KI in 100 mL) were added over 27 min by a double jet method. The flow rate of the aqueous solution Ag-3 during the addition was accelerated such that the final flow rate was 1.3 times the initial flow rate. Also, the aqueous solution X-3 was so added that the pAg of the bulk emulsion solution in the reaction vessel was held at 8.0 (addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by a double jet method. The addition of the aqueous solution Ag-4 was performed at a fixed flow rate. The addition of the aqueous solution X-4 was so performed that the pAg of the bulk emulsion solution in the reaction vessel was held at 7.7 (addition 4). After that, 125 mL of an aqueous solution G-3 (containing 12.0 g of gelatin-1 described above in 100 mL) was added.

After the temperature was decreased to 40° C., an aqueous solution containing 0.040 mole of sodium p-iodoasetoamidebenzensulfonate, which is an iodide ion-releasing agent, was added, then 60 mL of a 0.8 M aqueous solution of sodium sulfite was added over 1 min at a fixed rate, and the iodide ions were caused to generate while pH is controlled to 9.0. Two minutes after that the temperature was raised to 55° C. over 15 min, then pH was reduced to 5.5 (addition 5). One minute after that, sodium benzenethiosulfonate was added in a form of a solution in an amount of $2\times10^{-6}$ mol/mol Ag. One minute after that, 249 mL of the aqueous solution Ag-4 and the aqueous solution X-5 (containing 22.4 g of KBr in 100 mL) were added by a double jet method over 10 min. The addition of the aqueous solution Ag-4 was performed at a fixed flow rate. The addition of the aqueous solution X-5 was performed such that the pAg of the bulk emulsion solution in the reaction vessel was held at 7.4, and the final pAg was adjusted to 7.8 (addition 6). After that, desalting was performed by normal flocculation. Water, NaOH, and gelatin-1 described above were added under stirring, and the pH and the pAg were adjusted to 6.4 and 8.6, respectively, at 56° C.

The thus obtained emulsion was occupied by silver bromide tabular grains whose parallel main planes ware (111) planes, in an amount of 99% or more of the total projected area.

Subsequently, sensitizing dyes Exs-1 to Exs-3 set forth below, and potassium thiocyanate were added, then chloroauric acid in a form of a solution was added in an amount of $3\times10^{-6}$ mol/mol Ag. Then, sodium thiosulfate and N,N-dimethylselenourea were subsequently added, thereby optimum chemical sensitization was performed within a range that can be prepared with the amounts of these compounds. After that, water-soluble mercapto compounds MER-1 and MER-2 set forth below were added at a ratio of 4:1 such that the total amount was $3.6\times10^{-4}$ mol per mol of a silver halide, to terminate a chemical sensitization (chemical sensitization). Optimal chemical sensitization herein means the maximum sensitivity is obtained by exposure to light for 1/100 sec.

Sensitizing dye for green-sensitive emulsion Exs-1

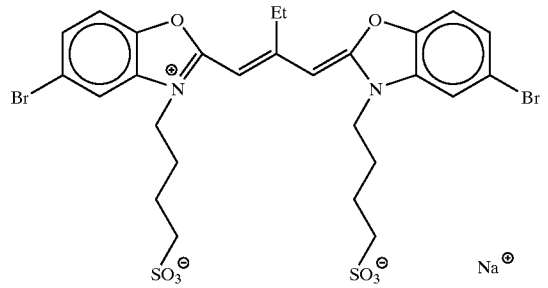

Sensitizing dye for green-sensitive emulsion Exs-2

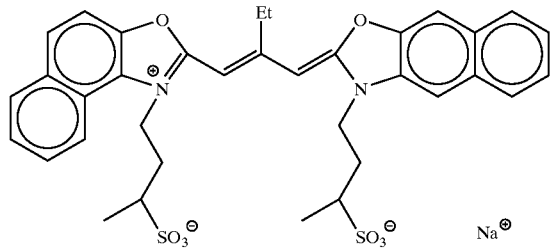

Sensitizing dye for green-sensitive emulsion Exs-3

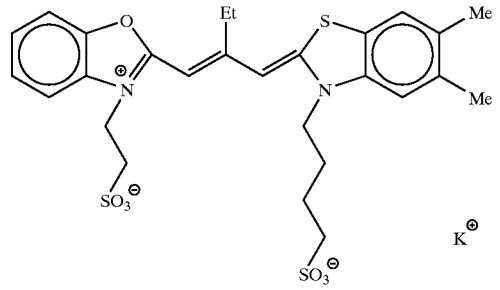

Sensitizing dyes used in the green-sensitive emulsions are a mixture of Exs-1:Exs-2:Exs-3=77:20:3 in a molar ratio

MER-1

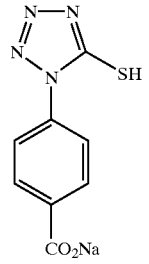

-continued

MER-2

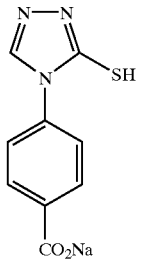

Emulsion 1-B

This emulsion was prepared in the same manner as Emulsion 1-A, except changing (Addition 3), the subsequent addition, (Addition 4) and (chemical sensitization) of Emulsion 1-A as follows. KI of the X-3 solution was reduced from 0.9 g to 0 g. After completion of Addition 3, the temperature of the resultant solution was lowered to 40° C., and then a solution containing 0.040 mol of p-iodeacetamidebenzenesulfonic acid sodium which is an iodide-ion-releasing agent was added. Thereafter, 60 ml of 0.8M sodium sulfite aqueous solution was added with a fixed quantity for 1 minute to generate iodide ions with the pH controlled at 9.0, and 2 minutes later the temperature of the resultant solution was raised to 55° C. for 15 minutes, and the pH thereof was reduced to 5.5. Further, a solution of $K_2IrCl_6$ and a solution of $K_3RhCl_6$ were added to the X-4 solution by $2\times10^{-7}$ mol and $6.4\times10^{-8}$ mol respectively for 1 mol of the total silver amount of completed grains. Further, after the (chemical sensitization), the resultant solution was agitated for 120 minutes by using a high-speed agitator with dissolver wings at 8000 rpm.

Emulsions 1-C, 1-E, 1-G, 1-I, 1-K, 1-M and 1-O

Tabular grain emulsions 1-C, 1-E, 1-G, 1-I, 1-K, 1-M and 1-O were prepared by preparing base grain emulsions having different equivalent circle diameters and thicknesses, by changing the grain forming conditions of (1st solution preparation) and (Addition 1) to (Addition 4) in Emulsion 1-A (pAg, addition speed, the kind and amount of gelatin, supply of silver and halide by continuous addition to the reactor of silver halide ultra-fine grains (having AgBrI with AgI content of 2 mol %, and a grain size of about 0.015 μm) prepared simultaneously by another agitating mixer outside the reactor).

Emulsions 1-D, 1-F, 1-H, 1-J, 1-L and 1-N

Tabular grain emulsions 1-D, 1-F, 1-H, 1-J, 1-L and 1-N were prepared by preparing base grain emulsions having different equivalent circle diameters and thicknesses, by changing the grain forming conditions of (1st solution preparation) and (Addition 1) to (Addition 4) in Emulsion 1-B (pAg, addition speed, the kind and amount of gelatin, supply of silver and halide by continuous addition to the reactor of silver halide ultra-fine grains (having AgBrI with AgI content of 2 mol %, and a grain size of about 0.015 μm) prepared simultaneously by another agitating mixer outside the reactor).

Emulsion 1-P

This emulsion was prepared in the same manner as Emulsion 1-O, except changing (Addition 3) and the subsequent additions of Emulsion 1-O as follows. KI of the X-3 solution was reduced from 0.9 g to 0 g. After completion of (Addition 3), the temperature of the resultant solution was lowered to 40° C., and then a solution containing 0.040 mol of sodium p-iodeacetamidebenzenesulfonate, which is an iodide-ion-releasing agent, was added. Thereafter, 60 ml of 0.8M sodium sulfite aqueous solution was added in a fixed quantity for 1 minute to generate iodide ions with the pH controlled at 9.0, and 2 minutes later the temperature of the resultant solution was raised to 55° C. for 15 minutes and the pH thereof was reduced to 5.5.

Emulsion 1-Q

This emulsion was prepared in the same manner as Emulsion 1-P, except changing (Addition 4) of Emulsion 1-P as follows. A solution of $K_2IrCl_6$ was added to the X-4 solution by $2\times10^{-7}$ mol per mol of the total silver amount of completed grains.

Emulsion 1-R

This emulsion was prepared in the same manner as Emulsion 1-Q, except changing (Addition 4) of Emulsion 1-Q as follows. A solution of $K_3RhCl_6$ was further added to the X-4 solution by $6.4\times10^{-8}$ mol per mol of the total silver amount of completed grains.

Emulsion 1-S

This emulsion was prepared in the same manner as Emulsion 1-R, except changing the steps after the (chemical sensitization) of Emulsion 1-R as follows. After the (chemical sensitization), the solution was agitated for 120 minutes by using a high-speed agitator with dissolver wings at 8000 rpm.

In preparation of these emulsions, the addition speeds of silver nitrate and the halide salt aqueous solutions were properly controlled to respective speeds proportional to the critical growth speed of silver halide grains so as not to cause polydispersion due to nuclear regeneration and Ostwald ripening.

Table 1 shows the grain properties of obtained Emulsions 1-A to 1-S.

Transmission electron microscope photographs of grains in each emulsion were taken by replica plating, and the forms of grains were determined by measuring 1000 grains in each emulsion. In each emulsion, the coefficient of variation of the equivalent circle diameter distribution of all grains did not exceed 40%.

TABLE 1

| Emulsion | Av. ESD of tabular grains ($D_{SP}$) (μm) | Aspect ratio (AR) | Shape of grains occupying 50% or more of the total grains | Dislocation line of internal portion of grain | Addition amount of Ir (mol/mol Ag) | Addition amount of Rh (mol/mol Ag) | High-speed stirring with dissolver blade |
|---|---|---|---|---|---|---|---|
| 1-A | 0.92 | 4.1 | $D_{SP} \geqq 0.8$ μm and AR ≧ 2 | None | 0 | 0 | Not done |
| 1-B | 0.92 | 4.1 | $D_{SP} \geqq 0.8$ μm and AR ≧ 2 | Present | $2 \times 10^{-7}$ | $6.4 \times 10^{-8}$ | Done |
| 1-C | 0.92 | 9.3 | $D_{SP} \geqq 0.8$ μm and AR ≧ 8 | None | 0 | 0 | Not done |
| 1-D | 0.92 | 9.3 | $D_{SP} \geqq 0.8$ μm and AR ≧ 8 | Present | $2 \times 10^{-7}$ | $6.4 \times 10^{-8}$ | Done |
| 1-E | 0.92 | 15.4 | $D_{SP} \geqq 0.8$ μm and AR ≧ 13 | None | 0 | 0 | Not done |
| 1-F | 0.92 | 15.4 | $D_{SP} \geqq 0.8$ μm and AR ≧ 13 | Present | $2 \times 10^{-7}$ | $6.4 \times 10^{-8}$ | Done |
| 1-G | 0.92 | 23.4 | $D_{SP} \geqq 0.8$ μm and AR ≧ 20 | None | 0 | 0 | Not done |
| 1-H | 0.92 | 23.4 | $D_{SP} \geqq 0.8$ μm and AR ≧ 20 | Present | $2 \times 10^{-7}$ | $6.4 \times 10^{-8}$ | Done |

TABLE 1-continued

| Emulsion | Av. ESD of tabular grains ($D_{SP}$) ($\mu$m) | Aspect ratio (AR) | Shape of grains occupying 50% or more of the total grains | Dislocation line of internal portion of grain | Addition amount of Ir (mol/mol Ag) | Addition amount of Rh (mol/mol Ag) | High-speed stirring with dissolver blade |
|---|---|---|---|---|---|---|---|
| 1-I | 1.49 | 4.3 | $D_{SP} \geqq 1.0$ $\mu$m and AR $\geqq 2$ | None | 0 | 0 | Not done |
| 1-J | 1.49 | 4.3 | $D_{SP} \geqq 1.0$ $\mu$m and AR $\geqq 2$ | Present | $2 \times 10^{-7}$ | $6.4 \times 10^{-8}$ | Done |
| 1-K | 1.49 | 9.1 | $D_{SP} \geqq 1.0$ $\mu$m and AR $\geqq 8$ | None | 0 | 0 | Not done |
| 1-L | 1.49 | 9.1 | $D_{SP} \geqq 1.0$ $\mu$m and AR $\geqq 8$ | Present | $2 \times 10^{-7}$ | $6.4 \times 10^{-8}$ | Done |
| 1-M | 1.49 | 13.1 | $D_{SP} \geqq 1.0$ $\mu$m and AR $\geqq 13$ | None | 0 | 0 | Not done |
| 1-N | 1.49 | 13.1 | $D_{SP} \geqq 1.0$ $\mu$m and AR $\geqq 13$ | Present | $2 \times 10^{-7}$ | $6.4 \times 10^{-8}$ | Done |
| 1-O | 1.49 | 26.6 | $D_{SP} \geqq 1.0$ $\mu$m and AR $\geqq 20$ | None | 0 | 0 | Not done |
| 1-P | 1.49 | 26.6 | $D_{SP} \geqq 1.0$ $\mu$m and AR $\geqq 20$ | Present | 0 | 0 | Not done |
| 1-Q | 1.49 | 26.6 | $D_{SP} \geqq 1.0$ $\mu$m and AR $\geqq 20$ | Present | $2 \times 10^{-7}$ | 0 | Not done |
| 1-R | 1.49 | 26.6 | $D_{SP} \geqq 1.0$ $\mu$m and AR $\geqq 20$ | Present | $2 \times 10^{-7}$ | $6.4 \times 10^{-8}$ | Not done |
| 1-S | 1.49 | 26.6 | $D_{SP} \geqq 1.0$ $\mu$m and AR $\geqq 20$ | Present | $2 \times 10^{-7}$ | $6.4 \times 10^{-8}$ | Done |

(Preparation of coated samples and their evaluations)

Cellulose triacetate film support provided with a subbing layer was coated with the each of the above Emulsions 1-A to 1-S, as set forth in Table 2, below.

TABLE 2

| Emulsion coating conditions | |
|---|---|
| (1) Emulsion layer | |
| Emulsion . . . Each emulsion | (Silver $1.63 \times 10^{-2}$ mol/m$^2$) |
| Coupler | ($2.26 \times 10^{-3}$ mol/m$^2$) |
| 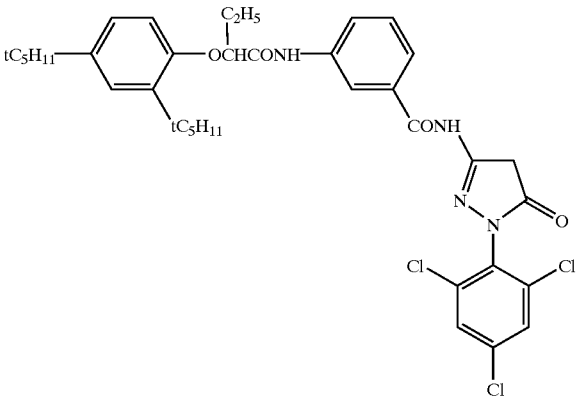 | |
| Tricresyl phosphate | (1.32 g/m$^2$) |
| Gelatin | (3.24 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

These samples were subjected to hardening processing for 14 hours under the conditions of 40° C., and 70% relative humidity.

Thereafter, in order to obtain development initiating points when irradiating radiation, gamma rays (1.173, 1.333 MeV) of radioisotope $^{60}$Co were irradiated to the applied samples. The radiation amount was set at an amount needed to initiate development initiating points of 50–55% (number ratio) of the emulsion grains in the light sensitive silver halide emulsion layer. For example, in the case of sample 101, the irradiation amount needed to initiate development initiating points of 50–55% (number ratio) of the emulsion grains in the light sensitive silver halide emulsion layer was 4.6R.

The samples irradiated were subjected to the following processing.

(Processing method)

| Step | Processing time | Processing temperature |
|---|---|---|
| Color development | 1 minute | 38° C. |
| Stop | 30 seconds | 20° C. |

(Color developing agent)

| | |
|---|---|
| p-N-methylaminophenol sulfate | 2.5 g |
| L-ascorbic acid | 10.0 g |
| Sodium metaborate tetrahydrate | 3.5 g |
| KBr | 1.0 g |
| $H_2O$ | 1 lit. |

(Stop Solution)

3% acetic acid aqueous solution

The emulsion surface of each sample after processing was soaked in a gelatin-degradating enzyme solution, and thereby films were stripped successively until reaching an emulsion layer to be observed. Then, carbon is deposited on silver halide grains of the emulsion layer to be observed remaining on a support, and its monochrome photographs were taken by a scanning electron microscope (about 5,000–30,000 magnifications). Development initiating points are observed in a filamentary form on the monochrome photograph. Then, the grains of the emulsion layer were classified by the number of development initiating points per grain, and the number of grains of each group was counted. Further, the ratio of the number of silver halide grains having two or more development initiating points per grain to those having at least one development initiating point per grain was determined. For example, in the case of sample 101, the number of grains of each group was as follows.

Number of grains having 0 development initiating points: 162

Number of grains having 1 development initiating point: 87

Number of grains having 2 or more development initiating points: 83

Therefore, the ratio of the number of silver halide grains having two or more development initiating points per grain to the number of silver halide grains having at least one development initiating point per grain was 49%.

With respect to the samples prepared as described above, white light having a color temperature of 5500 K was filtered by a yellow filter, and a wedge exposure of 1000 lux and 1/100 second was applied to each of the samples.

The samples subjected to the above exposure were subjected to the following development processing, and their photographic properties were evaluated by performing density measurement by a green filter.

(Processing Method)

| Step | Time | Temperature | Replenishment rate* |
|---|---|---|---|
| Color development | 2 min. 45 sec. | 38° C. | 45 mL |
| Bleaching | 1 min. 45 sec. | 38° C. | 20 mL bleaching solution overflow was entirely supplied into bleach-fix tank |
| Bleach-fix | 3 min. 15 sec. | 38° C. | 30 mL |
| Washing (1) | 40 sec. | 35° C. | counter flow piping from (2) to (1) |
| Washing (2) | 1 min. 00 sec. | 35° C. | 30 mL |
| Stabilization | 40 sec. | 38° C. | 20 mL |
| Drying | 1 min. 15 sec. | 55° C. | |

*The replenishment rate is represented by a value per 1.1 m of a 35-mm wide sample (equivalent to one role of 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxyaminesulfate | 2.4 | 2.8 |
| 4-[N-ethyl-N-(β-hydroxy ethyl)amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |

| (Bleaching solution) | common to tank solution and replenisher (g) |
|---|---|
| Ferric ammonium ethylenediamine tetraacetate dihydrate | 120.0 |
| Disodium ethylenediamine tetraacetate | 10.0 |
| Ammonium bromide | 100.0 |
| Ammonium nitrate | 10.0 |
| Bleaching accelerator $(CH_3)_2N—CH_2—CH_2-S-S-CH_2—CH_2—N(CH_3)_2.2HCl$ | 0.005 mol |
| Ammonia water (27%) | 15.0 mL |
| Water to make | 1.0 L |
| pH (adjusted by ammonia water and nitric acid) | 6.3 |

-continued

| (Bleach-fix bath) | Tank solution (g) | Replenisher (g) |
|---|---|---|
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulfate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |

(Washing water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The relative sensitivity of each sample was indicated by a relative value of a reciprocal of an exposure amount necessary to reach a density equal to the fog density plus 0.15 when performing exposure for 1/100 second (the sensitivity of sample 101 was indicated as 100).

Next, in order to evaluate radiation resistance, each of the applied samples 101–119 were irradiated with 0.2R of gamma-rays (1.173, 1.333 MeV) of radioisotope $^{60}Co$, subjected to development processing in the same manner as the above light exposure, and its density was measured to obtain the values of fog density. Based on this fog density and the fog density of the samples used in the above light exposure, the rise in fog due to irradiation of radiation to each sample was determined, and a relative value of each sample to the fog density of sample 101 was determined. The fog rise value of sample 101 was 0.087.

Further, gamma-rays of $^{60}Co$ were irradiated to each sample by an amount necessary to reach an optical density equal to plus 0.5, and development processing was performed in the same manner as the above light exposure. An RMS granularity measurement was performed for each of the developed samples to measure the granularity of each sample. Further, the relative value of the granularity of each sample to the granularity of sample 101 was determined. The RMS granularity of sample 101 was 0.038.

Table 3 shows the ratio of the number of silver halide grains having two or more development initiating points per grain to silver halide grains having one or more development initiating points per grain, the relative sensitivity, the rise in fog due to irradiation, the ratio of relative sensitivity to fog by irradiation, and the granularity after irradiation of each sample.

TABLE 3

| Sample | Emulsion | Number of grains having two or more development initiating points/Number of grains having one or more development initiating point (%) | A Relative sensitivity | B Fog increment due to radiation | A/B | RMS granularity when irradiated | Remarks |
|---|---|---|---|---|---|---|---|
| 101 | 1-A | 49 | 100 | 100 | 1.00 | 100 | Comp. |
| 102 | 1-B | 34 | 102 | 95 | 1.07 | 98 | Inv. |
| 103 | 1-C | 54 | 120 | 126 | 0.95 | 102 | Comp. |
| 104 | 1-D | 32 | 123 | 115 | 1.07 | 93 | Inv. |
| 105 | 1-E | 56 | 141 | 151 | 0.93 | 105 | Comp. |
| 106 | 1-F | 31 | 145 | 132 | 1.10 | 91 | Inv. |
| 107 | 1-G | 61 | 174 | 191 | 0.91 | 107 | Comp. |
| 108 | 1-H | 30 | 174 | 158 | 1.10 | 87 | Inv. |
| 109 | 1-I | 57 | 155 | 174 | 0.89 | 179 | Comp. |
| 110 | 1-J | 33 | 158 | 141 | 1.12 | 151 | Inv. |
| 111 | 1-K | 66 | 209 | 234 | 0.89 | 190 | Comp. |
| 112 | 1-L | 29 | 214 | 186 | 1.15 | 141 | Inv. |
| 113 | 1-M | 68 | 251 | 288 | 0.87 | 204 | Comp. |
| 114 | 1-N | 27 | 257 | 224 | 1.15 | 134 | Inv. |
| 115 | 1-O | 70 | 372 | 437 | 0.85 | 214 | Comp. |
| 116 | 1-p | 44 | 372 | 355 | 1.05 | 167 | Inv. |
| 117 | 1-Q | 39 | 380 | 339 | 1.12 | 151 | Inv. |
| 118 | 1-R | 32 | 372 | 316 | 1.18 | 138 | Inv. |
| 119 | 1-S | 23 | 380 | 302 | 1.26 | 126 | Inv. |

When sample 101 is compared with samples 102–119, it is clear that the sensitivity, the radiation resistance and the graininess of an emulsion are improved, in proportion to increase of the equivalent sphere diameter and the aspect ratio of the tabular grains of the present invention to be used. Further, the above properties of the emulsion are further improved by increase of the ratio of the number of silver halide grains having two or more development initiating points per grain to the number of silver halide grains having at least one development initiating point per grain.

Silver halide emulsions A to N were prepared by the following methods.

(Preparation Method of Emulsion A)

42.2L of an aqueous solution containing 31.7 g of low-molecular-weight gelatin having molecular weight of 15000 phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of gelatin-4 of Example 1 were added over 1 min by the double jet method. Immediately after the addition, 52.8 g of KBr were added, and 2,485 mL of an aqueous solution containing 398.2 g of $AgNO_3$ and 2,581 mL of an aqueous solution containing 291.1 g of KBr were added over 2 min by the double jet method. Immediately after the addition, 44.8 g of KBr were added. After that, the temperature was raised to 40° C. to ripen the material. After the ripening, 923 g of gelatin-2 of Example 1 and 79.2 g of KBr were added, and 15,974 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the pAg of the bulk emulsion solution in the reaction vessel was held at 9.90. After washing with water, gelatin-1 of Example 1 was added, the pH and the pAg were adjusted to 5.7 and 8.8, respectively, and the silver amount and the gelatin amount were adjusted to 131.8 g and 64.1 g, respectively, per kg of the emulsion, thereby preparing a seed emulsion.

1,211 mL of an aqueous solution containing 46 g of gelatin-2 of Example 1 and 1.7 g of KBr were vigorously stirred at 75° C. After 9.9 g of the seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.15. After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 $\mu$m was simultaneously added at an accelerated flow rate so that the silver iodide content was 27 mol %. At the same time, the pAg of the bulk emulsion solution in the reaction vessel was held at 8.60. 121.3 mL of an aqueous solution containing 45.6 g of $AgNO_3$ and an aqueous KBr solution were added over 22 min by the double jet method. During the addition, the pAg of the bulk emulsion solution in the reaction vessel was held at 7.60. The temperature was raised to 82 ° C., KBr was added to adjust the pAg of the bulk emulsion solution in the reaction vessel to 8.80, and the abovementioned AgI fine grain emulsion was added in an amount of 6.33 g in terms of a KI weight. Immediately after the addition, 206.2 mL of an aqueous solution containing 66.4 g of $AgNO_3$ were added over 16 min. For the first 5 min of the addition, the pAg of the bulk emulsion solution in the reaction vessel was held at 8.80. After washing with water, gelatin-1 of Example 1 was added, the pH and the pAg were adjusted to 5.8 and 8.7, respectively, at 40° C. After TAZ-1 was added, the temperature was raised to 60° C. After sensitizing dye ExS-4 was added, potassium thiocyanate, chloroauric acid, sodium thiosulfate, and N,N-dimethylselenourea were added to optimally perform chemical sensitization. At the end of this chemical sensitization, compounds MER-1 and MER-2 were added. "Optimal chemical sensitization" herein means that the addition amount of each of the sensitizing dyes and the compounds was $10^{-1}$ to $10^{-8}$ mol per mol of a silver halide.

Spectral sensitizing dye Exs-4 for the blue-sensitive emulsion

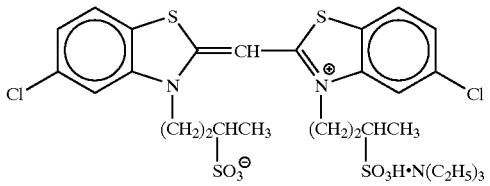

TAZ-1

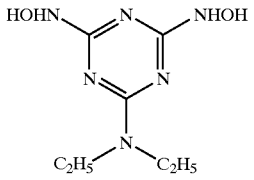

MER-1

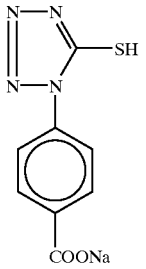

MER-3

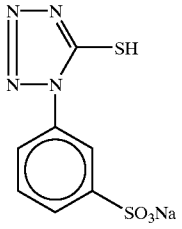

(Preparation Method of Emulsion B)

1,192 mL of an aqueous solution containing 0.96 g of gelatin-4 of Example 1 and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of gelatin-3 of Example 1 were added, and the pH was adjusted to 7. 6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the pAg of the bulk emulsion solution in the reaction vessel was held at 8.15. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of the emulsion A was simultaneously added at an accelerated flow rate so that the silver iodide content was 15.8 mol %. At the same time, the pAg of the bulk emulsion solution in the reaction vessel was held at 7.85.

96.5 mL of an aqueous solution containing 24.1 g of $AgNO_3$ and an aqueous KBr solution were added over 3 min by the double jet method. During the addition, the pAg of the bulk emulsion solution in the reaction vessel was held at 7.85. After 26 mg of sodium ethylthiosulfonate were added, the temperature was raised to 55° C., an aqueous KBr solution was added to adjust the pAg of the bulk emulsion solution in the reaction vessel to 9.80. The aforementioned AgI fine grain emulsion was added in an amount of 8.5 g in terms of a KI weight. Immediately after the addition, 228 mL of an aqueous solution containing 57 g of $AgNO_3$ were added over 5 min. During the addition, an aqueous KBr solution was used to adjust the pAg of the bulk emulsion solution in the reaction vessel such that the pAg was 8.75 at the end of the addition. The resultant emulsion was washed with water and chemically sensitized while compound Exs-4 was used as a spectral sensitizing dye.

(Preparation Method of Emulsion C)

1,192 mL of an aqueous solution containing 1.02 g of gelatin-2 of Example 1 and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of gelatin-3 of Example 1 and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the pAg of the bulk emulsion solution in the reaction vessel was held at 8.65. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of the emulsion A was simultaneously added at an accelerated flow rate so that the silver iodide content was 2.3 mol %. At the same time, the pAg of the bulk emulsion solution in the reaction vessel was held at 8.50.

After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the pAg of the bulk emulsion solution in the reaction vessel was held at 8.05. An aqueous KBr solution was added to adjust the pAg of the bulk emulsion solution in the reaction vessel to 9.25. The aforementioned AgI fine grain emulsion was added in an amount of 6.4 g in terms of a KI weight. Immediately after the addition, 404 mL of an aqueous solution containing 57 g of $AgNO_3$ were added over 45 min. During the addition, an aqueous KBr solution was used to adjust the pAg of the bulk emulsion solution in the reaction vessel such that the pAg was 8.65 at the end of the addition. After water washing, the emulsion was chemically sensitized while using compound Exs-4 as a spectral sensitizer.

(Preparation Method of Emulsion D)

In the preparation of the emulsion C, the $AgNO_3$ addition amount during nucleation was increased by 2.3 times. Also, in the final addition of 404 mL of an aqueous solution containing 57 g of $AgNO_3$, the pAg of the bulk emulsion solution in the reaction vessel was adjusted to 6.85 by using an aqueous KBr solution. An emulsion D was prepared following substantially the same procedures as for the emulsion C except the foregoing.

(Preparation Method of Emulsion E)

1,200 mL of an aqueous solution containing 0.75 g of gelatin-4 of Example 1 and 0.9 g of KBr were held at 39° C. and stirred with violence at pH 1.8. An aqueous solution containing 1.85 g of $AgNO_3$ and an aqueous KBr solution containing 1.5 mol of KI were added over 16 sec by the double jet method. During the addition, the excess KBr concentration was maintained. The temperature was raised to 54° C., and ripened the emulsion. After the termination of ripening, 20 g of gelatin-2 of Example 1 were added. After the pH was adjusted to 5.9, 2.9 g of KBr was added. 288 mL of an aqueous solution containing 2.74 g of $AgNO_3$ and a KBr solution was added by the double jet method over 53 min. During the addition, an AgI fine grain emulsion having a grain size of 0.03 $\mu$m was simultaneously added such that the silver iodide content was 4.1 mol %, and the pAg of the bulk emulsion solution in the reaction vessel was maintained at 9.40. After 2.5 g of KBr was added, an aqueous solution containing 87.7 g of $AgNO_3$ and a KBr solution was added by the double jet method over 63 min while the flow rate was accelerated so that the final flow rate was 1.2 times the initial flow rate. During the addition, the aforementioned AgI fine grain emulsion was simultaneously added at an accelerated flow rate such that the silver iodide content was 10.5 mol %. At the same time, the pAg of the bulk emulsion solution in the reaction vessel was held at 9.50.

132 mL of an aqueous solution containing 41.8 g of $AgNO_3$ and a KBr solution was added by the double jet method over 25 min. The addition of the KBr solution was so adjusted that the pAg of the bulk emulsion solution in the reaction vessel was 8.15 at the completion of the addition. After pH was adjusted to 7.3, 1 mg of thiourea dioxide was added. The pAg of the bulk emulsion solution was adjusted to 9.50 by adding a KBr solution, and then, the above AgI fine grain emulsion was added in an amount of 8.78 g in terms of a KI weight. Immediately after the addition, 609 mL of an aqueous solution containing 63.3 g of $AgNO_3$ were added over 10 min. For the first 6 min of the addition, the pAg of the bulk emulsion solution in the reaction vessel was held at 9.50. After washing with water, gelatin-1 of Example 1 was added, and pH and pAg were adjusted to 6.5 and 8.2, respectively. The chemical sensitization was performed optimally with spectral sensitizers Exs-1 to Exs-3.

(Preparation Method of Emulsion F)

1,200 mL of an aqueous solution containing 0.70 g of gelatin-4 of Example 1, 0.9 g of KBr, 0.175 g of KI, and 0.2 g of the modified silicon oil prepared in Emulsion A were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of gelatin-3 of Example 1 were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, geltin-4 of Example 1, an $AgNO_3$ solution and AgI fine grain emulsion prepared immediately before the addition in another chamber having a magnetic coupling inductive stirrer described in JP-A-10-43570, and having a grain size of 0.008 $\mu$m was simultaneously added such that the silver iodide content was 4.1 mol %, and the pAg of the bulk emulsion solution in the reaction vessel was maintained at 9.15.

After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, abovementioned AgI fine grain emulsion was simultaneously added such that the silver iodide content was 7.9 mol %. At the same time, the pAg of the bulk emulsion solution in the reaction vessel was held at 9.30. After adding 1 mg of thiourea dioxide, 132 mL of an aqueous solution containing 41.8 g of $AgNO_3$ and an aqueous KBr solution were added over 20 min by the double jet method. The addition of the aqueous KBr solution was so adjusted that the pAg of the bulk emulsion solution in the reaction vessel was 7.90 at the end of the addition. The temperature was raised to 78° C., and the pH was adjusted to 9.1. After KBr was added to adjust the pAg of the bulk emulsion solution in the reaction vessel to 8.70, the aforementioned AgI fine grain emulsion was added in an amount of 5.73 g in terms of a KI weight. Immediately after the addition, 321 mL of an aqueous solution containing 66.4 g of $AgNO_3$ were added over 4 min. For the first 2 min of the addition, the pAg of the bulk emulsion solution in the reaction vessel was held at 8.70 by an aqueous KBr solution. After washing with water, chemical sensitization was performed with spectral sensitizing dyes ExS-1 to ExS-3.

(Preparation Method of Emulsion G)

An aqueous solution containing 1.78 g of gelatin-1 of Example 1, 6.2 g of KBr and 0.46 g of KI were held at 45° C. and stirred with violence. An aqueous solution containing 11.85 g of $AgNO_3$ and an aqueous solution containing 3.2 mol % of KBr were added over 45 sec by the double jet method. The temperature was raised to 63° C. to ripen the material. After the ripening, 24.1 g of gelatin-1 of Example 1 were added and ripened. After the ripening, an aqueous solution containing 133.4 g of $AgNO_3$ and an aqueous KBr solution were added over 20 min by the double jet method such that the final flow rate was 2.6 times the initial flow rate. During the addition, the pAg of the bulk emulsion solution in the reaction vessel was held at 7.60. Also, ten minutes after the start of the addition 0.1 mg of $K_2IrCl_6$ was added. After 7 g of NaCl were added, an aqueous solution containing 45.6 g of $AgNO_3$ and an aqueous KBr solution were added over 12 min by the double jet method. During the addition, the pAg of the bulk emulsion solution in the reaction vessel was held at 6.90. Also, over 6 min from the start of the addition, 100 mL of an aqueous solution containing 29 mg of yellow prussiate were added. After 14.4 g of KBr were added, the AgI fine grain emulsion used in the preparation of the emulsion A was added in an amount of 6.3 g as a KI weight. Immediately after the addition, an aqueous solution containing 42.7 g of $AgNO_3$ and an aqueous KBr solution were added over 11 min by the double jet method. During the addition, the pAg of the bulk emulsion solution in the reaction vessel was held at 6.90. After washing with water, chemical sensitization was performed with sensitizing dyes Exs-1 to Exs-3.

(Preparation of Emulsion H)

Emulsion H was prepared in almost the same manner as in Emulsion G, except that the temperature at nucleation was changed to 35° C.

(Preparation Method of Emulsion I)

1,200 mL of an aqueous solution containing 0.75 g of gelatin-4 of Example 1 and 0.9 g of KBr were held at 39° C.

and stirred with violence at pH 1.8. An aqueous solution containing 0.34 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. The pH was adjusted to 5.9, and 2.9 g of KBr were added. After 3 mg of thiourea dioxide were added, and 288 mL of an aqueous solution containing 28.8 g of $AgNO_3$ and an aqueous KBr solution were added over 58 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 69 min by the double jet method while the flow rate was accelerated so that the final flow rate was 1.2 times the initial flow rate. During the addition, the abovementioned AgI fine grain emulsion was simultaneously added such that the silver iodide content was 10.5 mol %. At the same time, the pAg of the bulk emulsion solution in the reaction vessel was held at 9.50.

132 mL of an aqueous solution containing 41.8 g of $AgNO_3$ and an aqueous KBr solution were added over 27 min by the double jet method. The addition of the aqueous KBr solution was so adjusted that the pAg of the bulk emulsion solution in the reaction vessel was 8.15 at the end of the addition. After 2 mg of sodium benzenethiosulfonate were added, KBr was added to adjust the pAg of the bulk emulsion solution in the reaction vessel to 9.50, and the aforementioned AgI fine grain emulsion was added in an amount of 5.73 in terms of a KI weight. Immediately after the addition, 609 mL of an aqueous solution containing 66.4 g of $AgNO_3$ were added over 11 min. For the first 6 min of the addition, the pAg of the bulk emulsion solution in the reaction vessel was held at 9.50 by an aqueous KBr solution. After washing with water, gelatin was added, the pH and the pAg were adjusted to 6.5 and 8.2, respectively, at 40° C. Then, TAZ-1 was added and the temperature was raised to 56° C. The sensitizing dyes Exs-5 and Exs-6 (a mixing ratio=69:31) was added. After that, potassium thiocyanate, chloroauric acid, sodium thiosulfate, and N,N-dimethylselenourea were added to ripen and optimally chemically sensitize the emulsion. At the end of the chemical sensitization, MER-1 and MER-3 were added.

(Preparation Method of Emulsion J)

1,200 mL of an aqueous solution containing 0.38 g of gelatin-2 of Example 1 and 0.9 g of KBr were held at 60° C. and stirred with violence at pH 2. An aqueous solution containing 1.03 g of $AgNO_3$ and an aqueous solution containing 0.88 g of KBr and 0.09 g of KI were added over 30 sec by the double jet method. After ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of the emulsion A was simultaneously added at an accelerated flow rate such that the silver iodide content was 6.5 mol %. At the same time, the pAg of the bulk emulsion solution in the reaction vessel was held at 9.05.

After 1.5 mg of thiourea dioxide were added, 132 mL of an aqueous solution containing 41.8 g and an aqueous KBr solution were added over 16 min by the double jet method. The addition of the aqueous KBr solution was so adjusted that the pAg of the bulk emulsion solution in the reaction vessel as 7.70 at the end of the addition. After 2 mg of sodium benzenethiosulfonate were added, KBr was added to adjust the pAg of the bulk emulsion solution in the reaction vessel to 9.80. The abovementioned AgI fine grain emulsion was added in an amount of 6.2 g in terms of a KI weight. Immediately after the addition, 300 mL of an aqueous solution containing 88.5 g of $AgNO_3$ were added over 10 min. An aqueous KBr solution was added to adjust pAg of the bulk emulsion solution in the reaction vessel such that the pAg was 7.40 at the end of the addition. After washing with water, gelatin-1 of Example 1 was added, the pH and the pAg were adjusted to 6.5 and 8.2, respectively at 40° C. After TAZ-1 was added, the temperature was raised to 58° C. The sensitizing dyes Exs-7 to Exs-9 were added. After that, $K_2IrCl_6$, potassium thiocyanate, chloroauric acid, sodium thiosulfate, and N,N-dimethylselenourea were added to optimally perform chemical sensitization. At the end of the chemical sensitization, MER-1 and MER-3 were added.

Exs-5

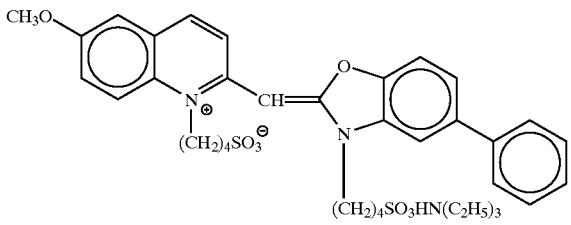

Exs-6

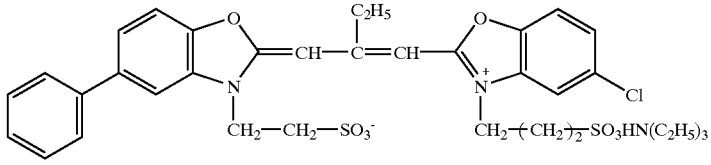

Sensitizing dye for red-sensitive emulsion Exs-7

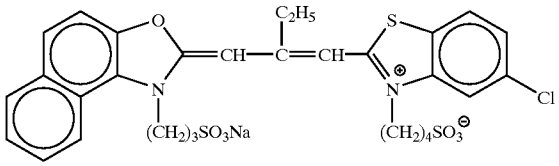

Sensitizing dye for red-sensitive emulsion Exs-8

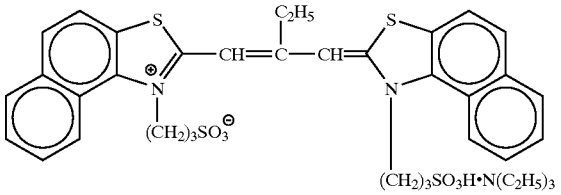

Sensitizing dye for red-sensitive emulsion Exs-9

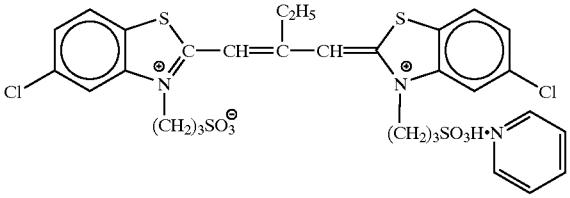

Sensitizing dyes used in red-sensitive emulsions are a mixture of Exs-7:Exs-8:Exs-9=40:2:58 in a molar ratio (Preparation of Emulsion K)

Emulsion K was prepared in the same manner as in emulsion J, except that, during nucleation, the amount of $AgNO_3$ was changed to 1.96 g, the amount of KBr as changed to 1.67 g, and the amount of KI was changed to 0.172 g. Also, the temperature during chemical sensitization was changed from 58° C. to 61° C. Other conditions were almost the same as Emulsion J.

(Preparation Method of Emulsion L)

1,200 mL of an aqueous solution containing 4.9 g of gelatin-4 of Example 1 and 5.3 g of KBr were vigorously stirred at 40° C. 27 mL of an aqueous solution containing 8.75 g of $AgNO_3$ and 36 mL of an aqueous solution containing 6.45 g of KBr were added over 1 min by the double jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate. The temperature was lowered to 55° C., 240 mL of an aqueous solution containing 7.1 g of $AgNO_3$ and an aqueous solution containing 6.46 g of KI were added over 5 min by the double jet method. After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double jet method. The resultant emulsion was washed with water and chemically sensitized in substantially the same manner as for the emulsion J.

(Preparation Methods of Emulsions M and N)

Emulsions M and N were prepared following substantially the same procedures as for the emulsions G and P, respectively, except that chemical sensitization was performed in substantially the same manner as for the emulsion K.

Characteristic values of the above silver halide emulsions are summarized in Table 4 below. The surface iodide content can be examined as follows by XPS. That is, a sample was cooled to −115° C. in a vacuum of $6.7\times10^{-4}$ Pa or less and irradiated with MgKα, as probe X-rays, at an X-ray source voltage of 8 kV and an X-ray current of 20 mA, thereby measuring Ag3d5/2, Br3d, and I3d5/2 electrons. The integral intensities of the measured peaks were corrected by a sensitivity factor, and the surface iodide content was calculated from these sensitivity ratios. Note that dislocation lines as described in JP-A-3-237450 were observed by a high-voltage electron microscope in silver halide grains of the emulsions A to N.

TABLE 4

| Emulsion | ECD (μm) COV (%) | Th (μm) COV (%) | Aspect ratio COV (%) | Tabularity | Twin plane distance (μm) COV (%) | Ratio of tabular grains having (111) main planes to the total projected area (%) | (100) face ratio in side faces (%) | AgI content (mol %) COV (%) | AgCl content (mol %) | Surface AgI content (mol %) |
|---|---|---|---|---|---|---|---|---|---|---|
| A | 1.98 | 0.198 | 10 | 51 | 0.014 | 92 | 23 | 15 | 0 | 4.3 |
| | 23 | 28 | 35 | | 32 | | | 17 | | |
| B | 1.30 | 0.108 | 12 | 111 | 0.013 | 93 | 22 | 11 | 0 | 3.6 |
| | 25 | 27 | 38 | | 30 | | | 16 | | |
| C | 1.00 | 0.083 | 12 | 145 | 0.012 | 93 | 18 | 4 | 1 | 1.8 |
| | 27 | 26 | 37 | | 30 | | | 8 | | |
| D | 0.75 | 0.075 | 10 | 133 | 0.010 | 91 | 33 | 4 | 2 | 1.9 |
| | 31 | 18 | 29 | | 27 | | | 8 | | |
| E | 1.54 | 0.077 | 20 | 260 | 0.013 | 99 | 23 | 8.4 | 0 | 6.2 |
| | 26 | 18 | 33 | | 26 | | | 8 | | |
| F | 1.08 | 0.072 | 15 | 208 | 0.008 | 97 | 23 | 6 | 0 | 2.0 |
| | 18 | 15 | 19 | | 22 | | | 5 | | |
| G | 0.44 | 0.220 | 2 | 9 | 0.013 | 90 | 38 | 3 | 2 | 1.0 |
| | 16 | 13 | 9 | | 18 | | | 6 | | |
| H | 0.33 | 0.165 | 2 | 12 | 0.013 | 88 | 42 | 3 | 2 | 1.0 |
| | 17 | 13 | 12 | | 18 | | | 6 | | |

TABLE 4-continued

| Emulsion | ECD (μm) COV (%) | Th (μm) COV (%) | Aspect ratio COV (%) | Tabularity | Twin plane distance (μm) COV (%) | Ratio of tabular grains having (111) main planes to the total projected area (%) | (100) face ratio in side faces (%) | AgI content (mol %) COV (%) | AgCl content (mol %) | Surface AgI content (mol %) |
|---|---|---|---|---|---|---|---|---|---|---|
| I | 2.25 | 0.107 | 21 | 197 | 0.013 | 99 | 20 | 7.2 | 0 | 2.4 |
| | 31 | 19 | 34 | | 33 | | | 7 | | |
| J | 2.38 | 0.138 | 17 | 125 | 0.013 | 98 | 23 | 5 | 1 | 1.6 |
| | 20 | 20 | 23 | | 19 | | | 6 | | |
| K | 1.83 | 0.122 | 15 | 123 | 0.012 | 98 | 23 | 5 | 1 | 1.8 |
| | 18 | 20 | 22 | | 19 | | | 6 | | |
| L | 0.84 | 0.120 | 7 | 58 | 0.013 | 99 | 25 | 3 | 0 | 2.7 |
| | 17 | 18 | 19 | | 16 | | | 7 | | |
| M | 0.44 | 0.220 | 2 | 9 | 0.013 | 88 | 42 | 2 | 2 | 1.0 |
| | 17 | 13 | 12 | | 18 | | | 6 | | |
| N | 0.33 | 0.165 | 2 | 12 | 0.013 | 88 | 46 | 1 | 2 | 0.5 |
| | 17 | 13 | 12 | | 18 | | | 6 | | |
| O | 0.07 | 0.070 | 1 | — | — | — | — | 1 | 0 | — |
| | — | — | — | | — | | | — | | |
| P | 0.07 | 0.070 | 1 | — | — | — | — | 0.9 | 0 | — |
| | — | — | — | | | | | — | | |

ECD = Equivalent circle diameter
COV = Coefficient of variation
Th = Thickness

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmϕ stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of sensitive layers (Sample 201)

The surface of the support on the side away from the back layers formed as above was coated with a plurality of layers having the following compositions to form a sample as a color negative sensitized material, thereby to prepare Sample 201.

(Compositions of Sensitive Layers)

The main ingredients used in the individual layers are classified as follows, however, the use thereof are not limited to those specified below.

ExC: Cyan coupler
ExM: Magenta coupler
ExY: Yellow coupler
UV: Ultraviolet absorbent
HBS: High-boiling organic solvent
H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| | |
|---|---|
| 1st Layer (first antihalation layer) | |
| Black colloidal silver | silver 0.155 |
| Silver iodobromide emulsion P | silver 0.01 |
| Gelatin | 0.87 |
| ExC-1 | 0.002 |
| ExC-3 | 0.002 |
| Cpd-2 | 0.001 |
| HBS-1 | 0.004 |
| HBS-2 | 0.002 |
| 2nd layer (second antihalation layer) | |
| Black colloidal silver | silver 0.066 |
| Gelatin | 0.407 |
| ExM-1 | 0.050 |
| ExF-1 | $2.0 \times 10^{-3}$ |
| HBS-1 | 0.074 |
| Solid-state disperse dye ExF-2 | 0.015 |
| Solid-state disperse dye ExF-3 | 0.020 |
| 3rd layer (intermediate layer) | |
| Silver iodobromide emulsion O | 0.020 |
| ExC-2 | 0.022 |
| Polyethylacrylate latex | 0.085 |
| Gelatin | 0.294 |
| 4th layer (low-speed red-sensitive emulsion layer) | |
| Silver iodochlorobromide emulsion N | silver 0.065 |
| Silver iodobromide emulsion S | silver 0.258 |
| ExC-1 | 0.109 |
| ExC-3 | 0.044 |
| ExC-4 | 0.072 |
| ExC-5 | 0.011 |
| ExC-6 | 0.003 |
| Cpd-2 | 0.025 |
| Cpd-4 | 0.025 |
| HBS-1 | 0.17 |
| Gelatin | 0.080 |

-continued

| | |
|---|---|
| 5th layer (medium-speed red-sensitive emulsion layer) | |
| Silver iodobromide emulsion L | silver 0.21 |
| Silver iodochlorobromide emulsion K | silver 0.62 |
| ExC-1 | 0.14 |
| ExC-2 | 0.026 |
| ExC-3 | 0.020 |
| ExC-4 | 0.12 |
| ExC-5 | 0.016 |
| ExC-6 | 0.007 |
| Cpd-2 | 0.036 |
| Cpd-4 | 0.028 |
| HBS-1 | 0.16 |
| Gelatin | 1.18 |
| 6th layer (high-speed red-sensitive emulsion layer) | |
| Silver iodochlorobromide emulsion J | silver 1.47 |
| ExC-1 | 0.18 |
| ExC-3 | 0.07 |
| ExC-6 | 0.029 |
| ExC-7 | 0.010 |
| ExY-5 | 0.008 |
| Cpd-2 | 0.046 |
| Cpd-4 | 0.077 |
| HBS-1 | 0.25 |
| HBS-2 | 0.12 |
| Gelatin | 2.12 |
| 7th layer (intermediate layer) | |
| Cpd-1 | 0.089 |
| Solid-state disperse dye ExF-4 | 0.030 |
| HBS-1 | 0.050 |
| Polyethylacrylate latex | 0.83 |
| Gelatin | 0.84 |
| 8th layer (layer for providing interlayer effect to red-sensitive layers) | |
| Silver iodobromide emulsion I | silver 0.560 |
| Cpd-4 | 0.030 |
| ExM-2 | 0.096 |
| ExM-3 | 0.028 |
| ExY-1 | 0.031 |
| ExG-1 | 0.006 |
| HBS-1 | 0.085 |
| HBS-3 | 0.003 |
| Gelatin | 0.58 |
| 9th layer (low-speed green-sensitive emulsion layer) | |
| Silver iodochlorobromide emulsion H | silver 0.39 |
| Silver iodochlorobromide emulsion G | silver 0.28 |
| Silver iodobromide emulsion F | silver 0.35 |
| ExM-2 | 0.36 |
| ExM-3 | 0.045 |
| ExG-1 | 0.005 |
| HBS-1 | 0.28 |
| HBS-3 | 0.01 |
| HBS-4 | 0.27 |
| gelatin | 1.39 |
| 10th layer (medium-speed green-sensitive emulsion layer) | |
| Silver iodobromide emulsion E | silver 0.45 |
| ExC-6 | 0.009 |
| ExM-2 | 0.031 |
| ExM-3 | 0.029 |
| ExY-1 | 0.006 |
| ExM-4 | 0.028 |
| ExG-1 | 0.005 |
| HBS-1 | 0.064 |
| HBS-3 | $2.1 \times 10^{-3}$ |
| Gelatin | 0.44 |
| 11th layer (high-speed green-sensitive emulsion layer) | |
| Silver iodobromide emulsion 1-E of Example 1 | silver 0.99 |
| ExC-6 | 0.004 |
| ExM-1 | 0.016 |
| ExM-3 | 0.036 |
| ExM-4 | 0.020 |
| ExM-5 | 0.004 |

-continued

| | |
|---|---|
| ExY-5 | 0.003 |
| ExM-2 | 0.013 |
| ExG-1 | 0.005 |
| Cpd-4 | 0.007 |
| HBS-1 | 0.18 |
| Polyethylacrylate latex | 0.099 |
| Gelatin | 1.11 |
| 12th layer (yellow filter layer) | |
| Yellow colloidal silver | silver 0.047 |
| Cpd-1 | 0.16 |
| Solid-state disperse dye ExF-5 | 0.010 |
| Solid-state disperse dye ExF-6 | 0.010 |
| Solid-state disperse dye ExF-8 | 0.020 |
| Oil soluble dye ExF-7 | 0.010 |
| HBS-1 | 0.082 |
| Gelatin | 1.057 |
| 13th layer (low-speed blue-sensitive emulsion layer) | |
| Silver iodochlorobromide emulsion D | silver 0.18 |
| Silver iodobromide emulsion B | silver 0.20 |
| Silver iodochlorobromide emulsion C | silver 0.07 |
| ExC-1 | 0.041 |
| ExC-8 | 0.012 |
| ExY-1 | 0.035 |
| ExY-2 | 0.71 |
| ExY-3 | 0.10 |
| ExY-4 | 0.005 |
| Cpd-2 | 0.10 |
| Cpd-3 | $4.0 \times 10^{-3}$ |
| HBS-1 | 0.24 |
| Gelatin | 1.41 |
| 14th layer (high-speed blue-sensitive emulsion layer) | |
| Silver iodobromide emulsion A | silver 0.75 |
| ExC-1 | 0.013 |
| ExY-2 | 0.31 |
| ExY-3 | 0.05 |
| ExY-6 | 0.062 |
| Cpd-2 | 0.075 |
| Cpd-3 | $1.0 \times 10^{-3}$ |
| HBS-1 | 0.10 |
| Gelatin | 0.91 |
| 15th layer (first protective layer) | |
| Silver iodobromide emulsion O | silver 0.30 |
| UV-1 | 0.21 |
| UV-2 | 0.13 |
| UV-3 | 0.20 |
| UV-4 | 0.025 |
| F-11 | 0.009 |
| F-18 | 0.005 |
| F-19 | 0.005 |
| HBS-1 | 0.12 |
| HBS-4 | $5.0 \times 10^{-2}$ |
| Gelatin | 2.3 |
| 16th layer (second protective layer) | |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, the samples were prepared by adding $8.5\times10^{-3}$ g and $7.9\times10^{-3}$ g, per mol of a silver halide, of calcium in the form of an aqueous calcium nitrate solution to the coating solutions of the 8th and 11th layers, respectively. Preparation of Dispersions of Organic Solid Disperse dyes ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-4 was obtained. The average grain sizes of the fine dye grains was 0.45 μm. ExF-2 was dispersed by a microprecipitation dispersion method described in Example 1 of EP549,489A. The average grain size was found to be 0.06 μm.

A solid dispersion ExF-6 was dispersed by the following method.

4000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

(Preparation of Solid Fine Dispersion of a Sensitizing Dye)

The sensitizing dyes of the invention were used in a form of a solid fine dispersion that was prepared in the method of JP-A-11-52507.

For example, solid fine dispersion of Sensitizing dye ExC-1 was prepared as follows.

0.8 parts by weight of $NaNO_3$ and 3.2 parts by weight of $Na_2SO_4$ were dissolved into 43 parts by weight of ion-exchanged water. 13 parts by weight of the sensitizing dye ExC-1 was added thereto and dispersed by using a dissolver blade at 2000 rpm for 20 min under the condition of 60° C. to obtain a solid dispersion of sensitizing dye ExC-1.

Compounds used in the formation of each layer were as follows.

Exs-1

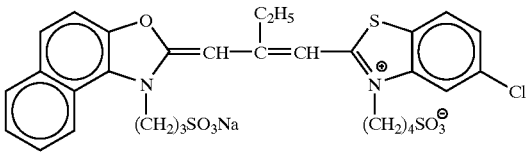

Exs-2

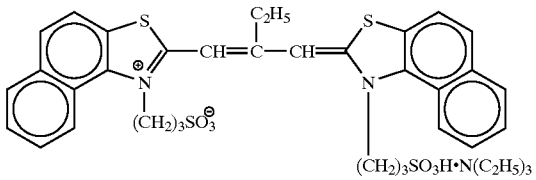

-continued
Exs-3
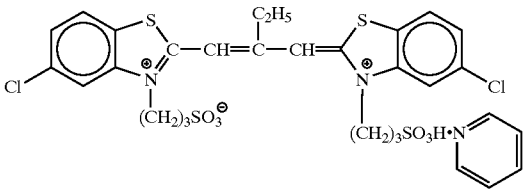
ExC-1
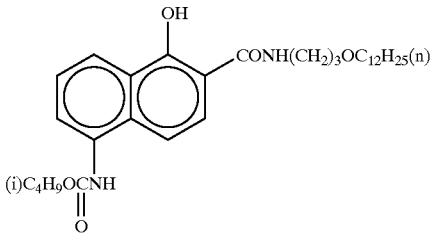
ExC-2
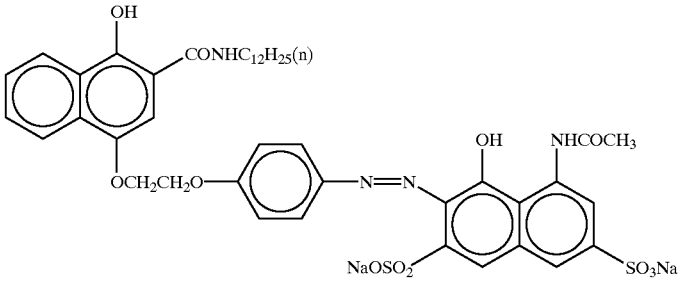
ExC-3
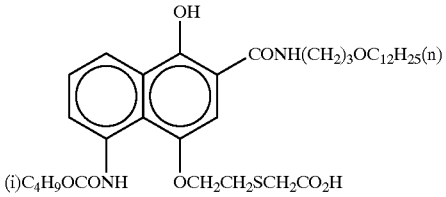
ExC-4
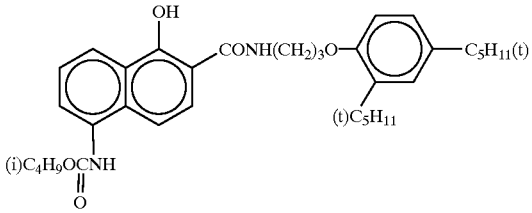
ExC-5
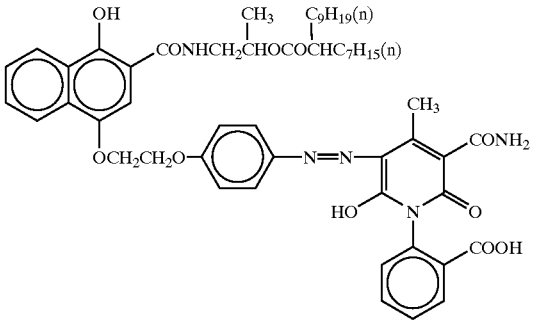
ExC-6
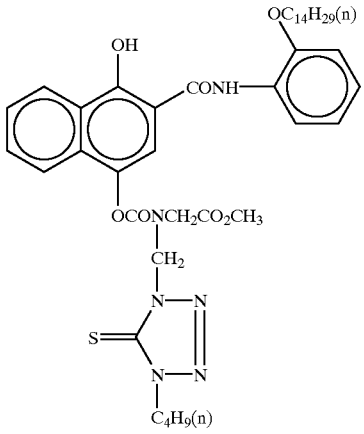
ExC-7
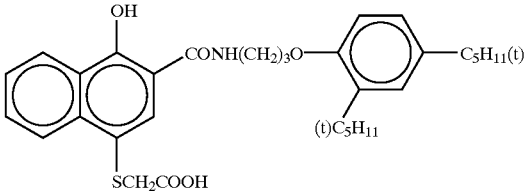

-continued
ExC-8
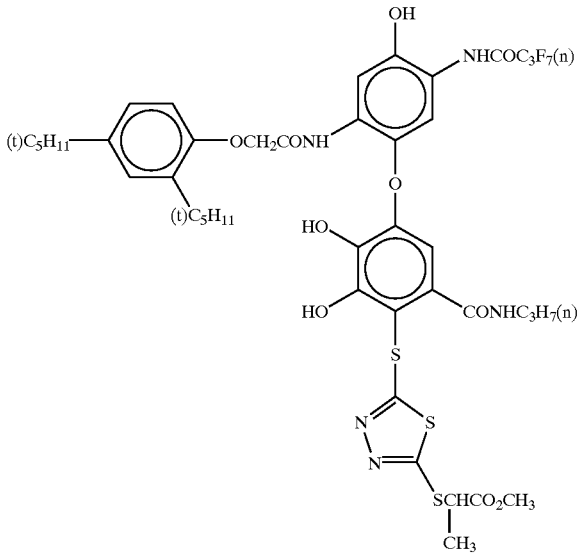
ExM-1
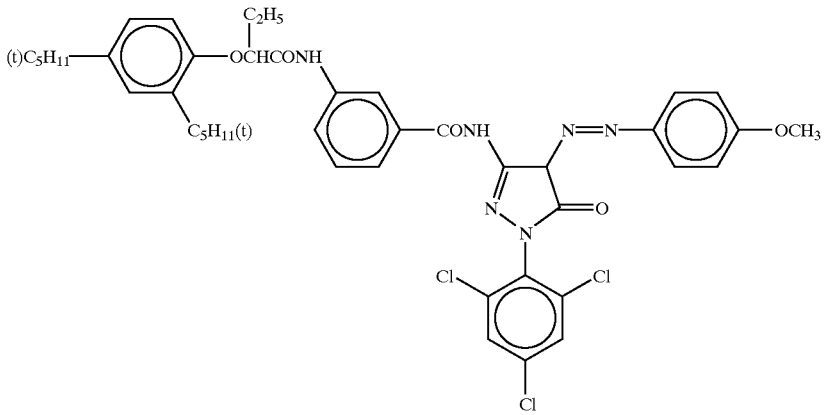
ExM-2
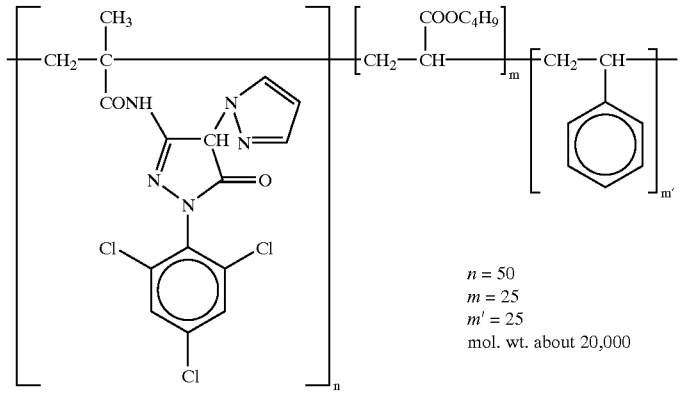

-continued
ExM-3
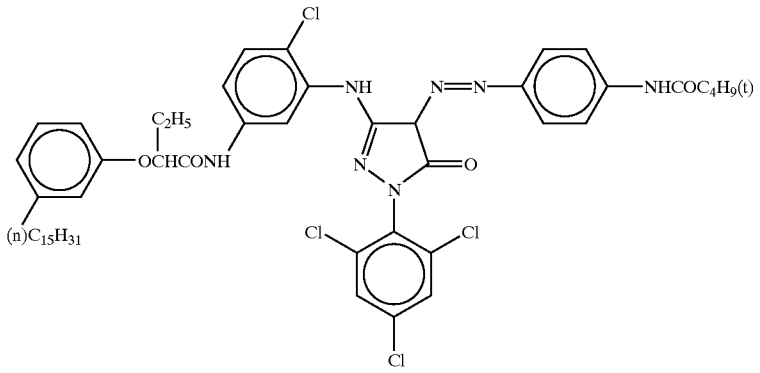
ExM-4
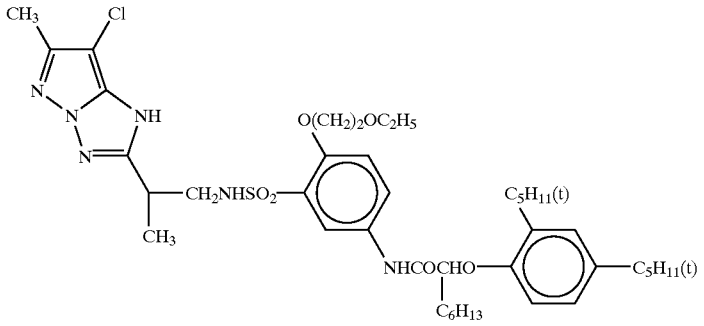
ExM-5
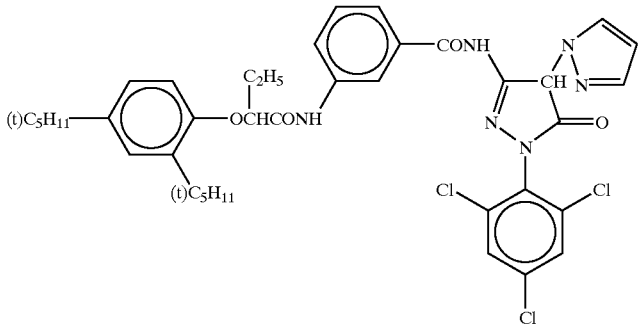
ExY-1
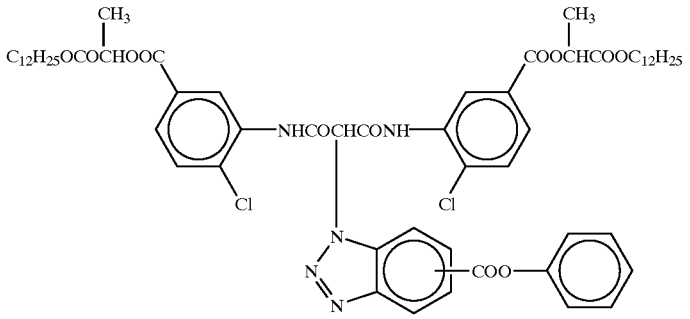
ExY-2
ExY-3
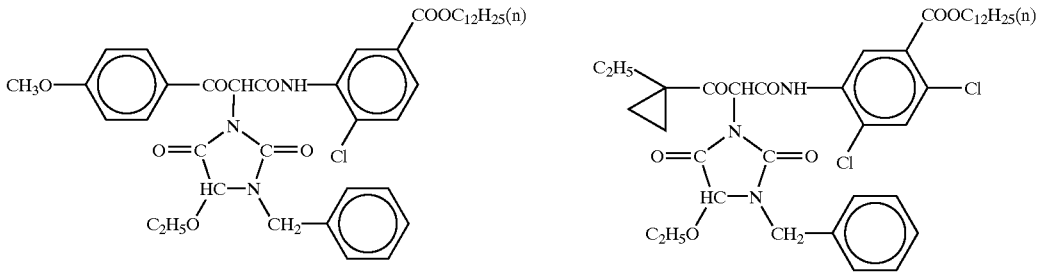

-continued
ExY-4
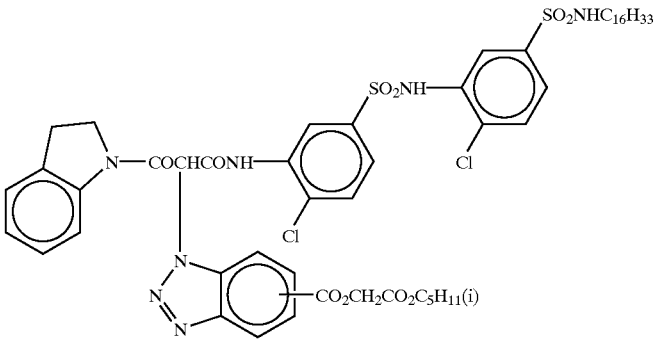
ExY-5
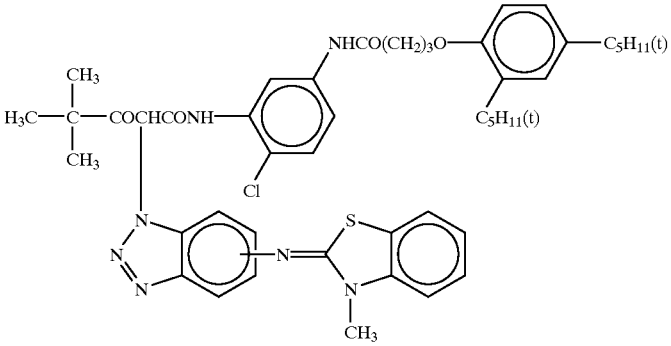
ExY-6
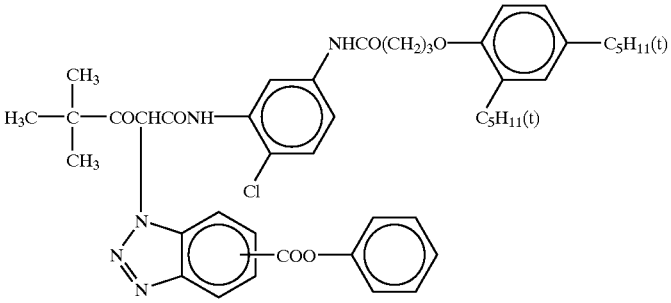
ExG-1
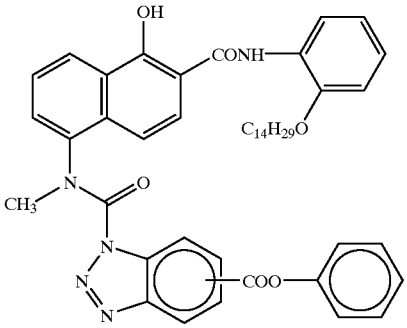
ExF-1
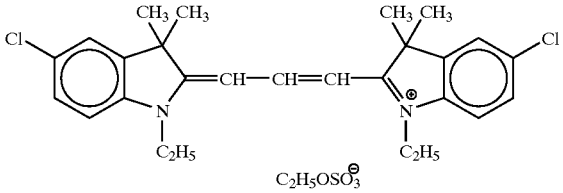
ExF-2
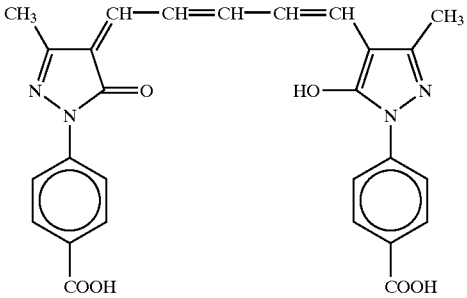

-continued
ExF-3
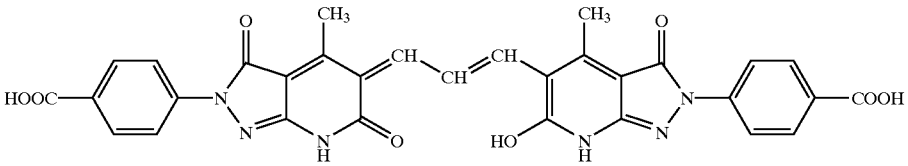
ExF-4
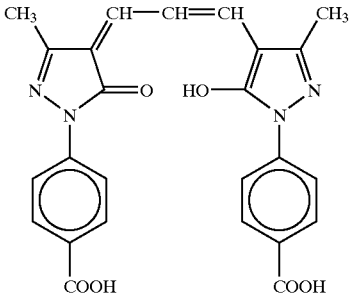
ExF-5
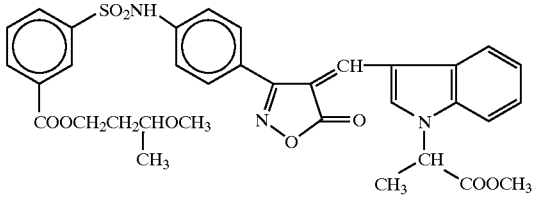
ExF-6
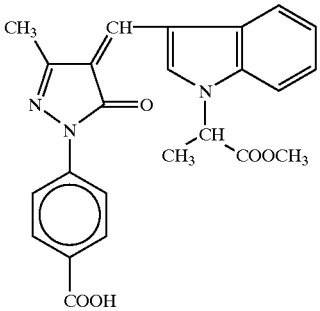
Cpd-1
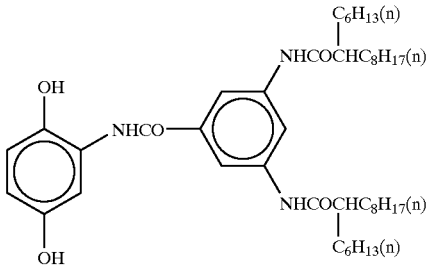
Cpd-2
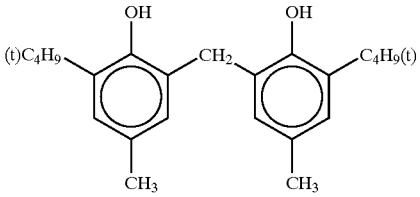
Cpd-3
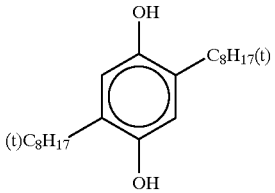
Cpd-4
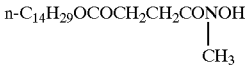
UV-1
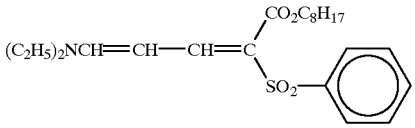
UV-2
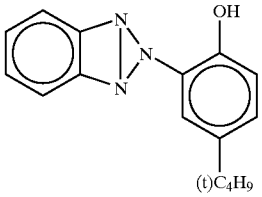
UV-3
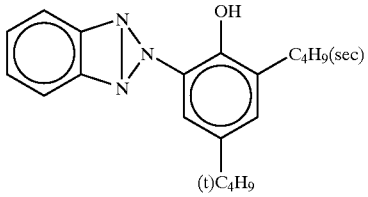
UV-4
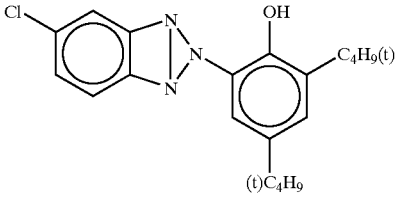
HBS-1
Tricresyl phosphate -continued
Di-n-butyl phthalate
HBS-2
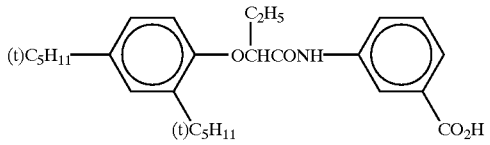
HBS-3
Tri(2-ethylhexyl) phosphate
HBS-4
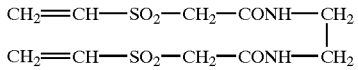
H-1
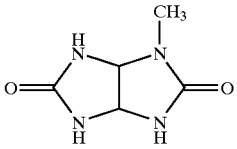
S-1
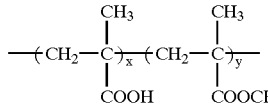
x/y = 10/90 (Wt. ratio)
Av. Mol. Wt.: about 35,000
B-1
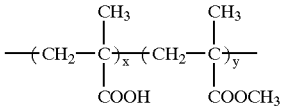
x/y = 40/60 (Wt. ratio)
Av. Mol. Wt.: about 20,000
B-2
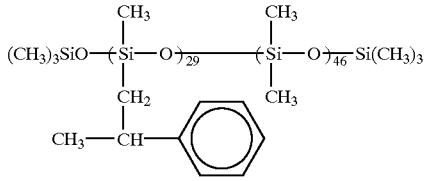
(Molar ratio)
Av. Mol. Wt.: about 8,000
B-3
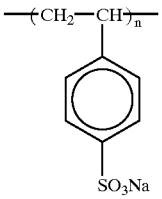
Av. Mol. Wt.: about 750,000
B-4
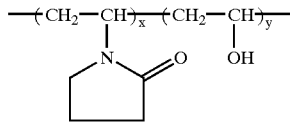
x/y = 70/30 (Wt. ratio)
Av. Mol. Wt.: about 17,000
B-5
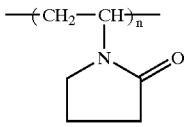
Av. Mol. Wt.: about 10,000
B-6
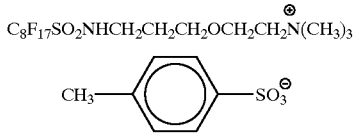
W-1
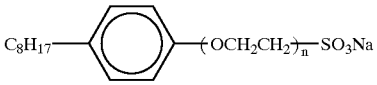
$n$ = 2–4
W-2
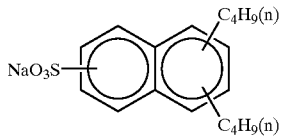
W-3
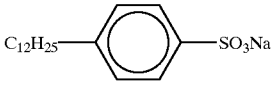
W-4
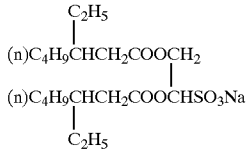
W-5

-continued
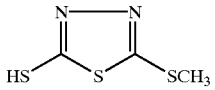
F-1
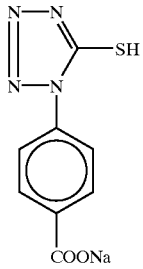
F-2
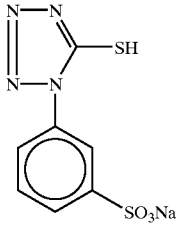
F-3
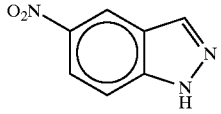
F-4
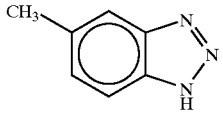
F-5
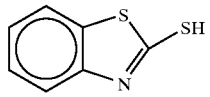
F-6
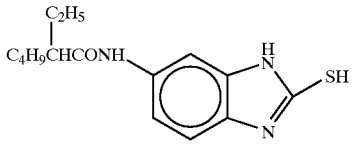
F-7
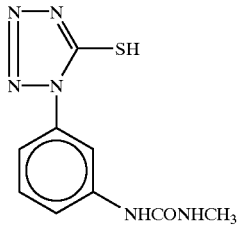
F-8
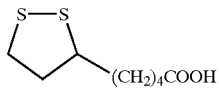
F-9
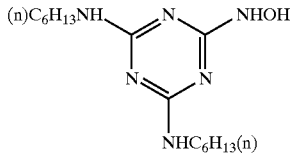
F-10
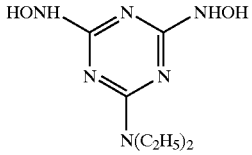
F-11
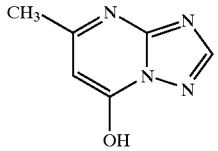
F-12
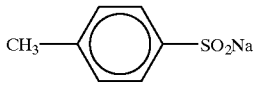
F-13
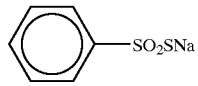
F-14
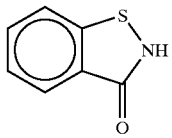
F-15
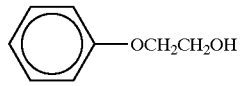
F-16

-continued

F-17

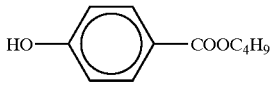

F-18

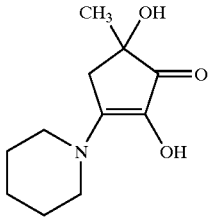

F-19

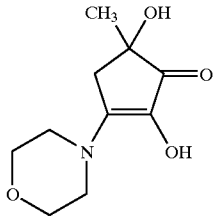

(Preparation of Samples 202 to 211)

Samples 201 to 211 were prepared by using emulsions 1-F to 1-H, and 1-M to 1-S instead of emulsion 1-E of the eleventh layer.

These samples were subjected to hardening processing for 14 hours under the conditions of 40° C. and relative humidity 70%. Thereafter, development initiating points of a high-speed green-sensitive emulsion layer of each sample were observed in the same manner as Example 1. Then, the ratio of the number of silver halide grains having two or more development initiating points per grain to the number of silver halide grains having one or more development initiating point per grain was determined.

The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing Steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C, | — 5 | L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — 3 | L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | [Tank solution] (g) | [Replenisher] (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixer (1) Tank Solution)

A 5:95 mixture (v/v) of the above bleaching tank solution and the below fixing tank solution pH 6.8

| (Fixer (2)) | [Tank solution] (g) | [Replenisher] (g) |
|---|---|---|
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1 L | 1 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Sodium 1,2-benzisothiazoline-3-on | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The photographic properties of the processed samples were evaluated by measuring the density of each sample by a green filter. The sensitivity of each sample was evaluated by the relative value of a reciprocal of a light exposure necessary to increase the magenta density to reach a density equal to the fog density plus 0.15.

Next, in order to evaluate the radiation resistance, each of the applied samples 201–211 was irradiated with 0.2 R of gamma rays (1.173, 1.333 MeV) of radioisotope $^{60}$Co, and thereafter subjected to development processing in the same manner as the above light exposure, and the density of each of the developed samples was measured to determine the value of the fog density of the magenta density portion. Based on these values and the fog density of each sample used in the above light exposure, the rise in fog due to irradiation of each sample is determined, and the relative value of the rise of each sample to the rise in fog of sample 201 was determined. The fog rise value of sample 201 was 0.122.

Further, gamma rays of $^{60}$Co were irradiated to each sample by an amount necessary for the magenta density portion to reach an optical density equal to plus 0.5, and development processing was performed in the same manner as in the above light exposure. An RMS granularity measurement was performed for each of the developed samples to measure the granularity of each sample. Further, the relative value of the granularity of each sample to the granularity of sample 201 was determined. The RMS granularity of sample 201 was 0.040.

The results are shown in Table 5.

TABLE 5

| Sample | Emulsion | Number of grains having two or more development initiating points/Number of grains having one or more development initiating point (%) | A Relative sensitivity | B Fog increment due to radiation | A/B | RMS granularity when irradiated | Remarks |
|---|---|---|---|---|---|---|---|
| 201 | 1-E | 57 | 100 | 100 | 1.00 | 100 | Comp. |
| 202 | 1-F | 32 | 102 | 89 | 1.15 | 85 | Inv. |
| 203 | 1-G | 63 | 123 | 129 | 0.95 | 105 | Comp. |
| 204 | 1-H | 33 | 123 | 107 | 1.15 | 79 | Inv. |
| 205 | 1-M | 69 | 178 | 195 | 0.91 | 199 | Comp. |
| 206 | 1-N | 28 | 182 | 148 | 1.23 | 122 | Inv. |
| 207 | 1-O | 71 | 263 | 295 | 0.89 | 214 | Comp. |
| 208 | 1-p | 45 | 269 | 229 | 1.17 | 162 | Inv. |
| 209 | 1-Q | 41 | 263 | 219 | 1.20 | 138 | Inv. |
| 210 | 1-R | 35 | 263 | 200 | 1.32 | 126 | Inv. |
| 211 | 1-S | 25 | 269 | 191 | 1.41 | 116 | Inv. |

In the same manner as the result shown in Example 1, the effect of the present invention was also remarkable in a color negative interlayer.

Further, the other emulsions prepared in Example 1 were evaluated in the same manner as the above, and their relative relationships were the same also in a color negative interlayer.

Furthermore, an image taken with a negative of sample 211 is scanned by using a digital laboratory system "Frontier" manufactured by Fuji Photo Film Co., Ltd., subjected to digital image processing (graininess removal and sharpness emphasis processing with a color reproduction property of color negative "SUPER 400" manufactured by Fuji Photo Film Co., Ltd.) in a work station, and outputted by a laser printer. Consequently, a photograph of very good image quality was obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic lightsensitive material having at least one lightsensitive silver halide emulsion layer on a support, wherein at least one layer of said lightsensitive silver halide emulsion layers comprises a lightsensitive silver halide emulsion containing silver halide grains in which a ratio of "the number of silver halide grains having at least two development initiating points per grain" to "the number of silver halide grains having at least one development initiating point per grain" is 45% or less when the silver halide photographic lightsensitive material is subjected to radiation and subsequent development under the following conditions, Conditions of irradiation:

(Radiation source) gamma rays irradiated from $^{60}Co$ (Radiation amount) enough to expose 50–55% (number ratio) of the silver halide grains contained in the lightsensitive silver halide emulsion layer to have at least one development initiating point Conditions of development:

(Processing method)

| Step | Processing time | Processing temperature |
|---|---|---|
| Color development | 1 minute | 38° C. |
| Stop | 30 seconds | 20° C. |

(Color developing agent)

| | |
|---|---|
| p-N-methylaminophenol sulfate | 2.5 g |
| L-ascorbic acid | 10.0 g |
| Sodium metaborate tetrahydrate | 3.5 g |
| KBr | 1.0 g |
| $H_2O$ | 1 lit |

(Stop Solution)

3% acetic acid aqueous solution.

2. The silver halide photographic lightsensitive material according to claim 1, wherein the ratio of "the number of silver halide grains having at least two development initiating points per grain" to "the number of silver halide grains having at least one development initiating point per grain" is 35% or less.

3. The silver halide photographic lightsensitive material according to claim 1, wherein the lightsensitive silver halide emulsion comprises silver iodobromide or silver iodochlorobromide tabular grains having (111) faces as main planes, an average equivalent sphere diameter of 0.8 μm or more, and an average aspect ratio of 2 or more.

4. The silver halide photographic lightsensitive material according to claim 2, wherein the lightsensitive silver halide emulsion comprises silver iodobromide or silver iodochlorobromide tabular grains having (111) faces as main planes, an average equivalent sphere diameter of 0.8 μm or more, and an average aspect of 2 or more.

5. The silver halide photographic lightsensitive material according to claim 3, wherein the average aspect ratio is 8 or more.

6. The silver halide photographic lightsensitive material according to claim 4, wherein the average aspect ratio is 8 or more.

7. The silver halide photographic lightsensitive material according to claim 3, wherein the average aspect ratio is 13 or more.

8. The silver halide photographic lightsensitive material according to claim 4, wherein the average aspect ratio is 13 or more.

9. The silver halide photographic lightsensitive material according to claim 3, wherein the average aspect ratio is 20 or more.

10. The silver halide photographic lightsensitive material according to claim 4, wherein the average aspect ratio is 20 or more.

11. The silver halide photographic lightsensitive material according to claim 3, wherein the average equivalent sphere diameter is 1.0 μm or more.

12. The silver halide photographic lightsensitive material according to claim 4, wherein the average equivalent sphere diameter is 1.0 μm or more.

13. The silver halide photographic lightsensitive material according to claim 5, wherein the average equivalent sphere diameter is 1.0 μm or more.

14. The silver halide photographic lightsensitive material according to claim 6, wherein the average equivalent sphere diameter is 1.0 μm or more.

15. The silver halide photographic lightsensitive material according to claim 7, wherein the average equivalent sphere diameter is 1.0 μm or more.

16. The silver halide photographic lightsensitive material according to claim 8, wherein the average equivalent sphere diameter is 1.0 μm or more.

17. The silver halide photographic lightsensitive material according to claim 9, wherein the average equivalent sphere diameter is 1.0 μm or more.

18. The silver halide photographic lightsensitive material according to claim 10, wherein the average equivalent sphere diameter is 1.0 μm or more.

* * * * *